US006027587A

United States Patent [19]

Hodgson et al.

[11] Patent Number: 6,027,587

[45] Date of Patent: Feb. 22, 2000

[54] STRAIN-INDUCED TRANSFORMATION TO ULTRAFINE MICROSTRUCTURE IN STEEL

[75] Inventors: Peter Damian Hodgson, Selby; Mark Richard Hickson, Richmond; Russell Keith Gibbs, Newport, all of Australia

[73] Assignee: The Broken Hill Proprietary Company Limited, Melbourne, Australia

[21] Appl. No.: 08/569,164

[22] PCT Filed: Jun. 29, 1994

[86] PCT No.: PCT/AU94/00356

§ 371 Date: Jun. 25, 1996

§ 102(e) Date: Jun. 25, 1997

[87] PCT Pub. No.: WO95/01459

PCT Pub. Date: Jan. 12, 1995

[30] Foreign Application Priority Data

| | | | |
|---|---|---|---|
| Jun. 29, 1993 | [AU] | Australia | PL9684 |
| Jun. 29, 1993 | [AU] | Australia | PL9685 |
| Jun. 29, 1993 | [AU] | Australia | PL9686 |

[51] Int. Cl.[7] ..... C21D 8/00

[52] U.S. Cl. ..... 148/654; 148/648

[58] Field of Search ..... 148/320, 334, 148/546, 648, 654

[56] References Cited

U.S. PATENT DOCUMENTS

| | | | |
|---|---|---|---|
| 4,466,842 | 8/1984 | Yada et al. . | |
| 5,200,005 | 4/1993 | Najah-Zadeh et al. | 148/648 |

FOREIGN PATENT DOCUMENTS

| | | |
|---|---|---|
| 83-7502341 | 7/1983 | Japan . |
| 84-278448 | 9/1984 | Japan . |

*Primary Examiner*—Deborah Yee
*Attorney, Agent, or Firm*—Nikaido Marmelstein Murray & Oram LLP

[57] ABSTRACT

Steel with ultrafine grains is produced by altering the transformation from one which normally proceeds with grain boundary nucleation followed by intragranular nucleation at deformation bands and other defects, to one which induces a substantially instantaneous transformation homogeneously over the austenite grain. This is favoured by a reduction or minimisation of grain boundary nucleation, (for example by enlargement of the austenite grain size), prior to or during the transformation. In an embodiment, a partially cooled austenite phase steel is deformed in a single pass at a temperature in the range of 700–950° C. to obtain ferrite grain size of 5 μm or less.

39 Claims, 21 Drawing Sheets

STRAIN-INDUCED TRANSFORMATION TO ULTRAFINE MICROSTRUCTURE IN STEEL

BACKGROUND OF THE INVENTION

1. Technical Field

This invention relates to the production and processing of steels to achieve ultrafine microstructures. For example, in a ferrite containing steel, ultrafine microstructures are considered to be those having a significant proportion of grains of a size less than 5 microns in a plain carbon steel, or less than 3 microns in a microalloyed steel.

2. Related Art

One of the principal aims of modem steel processing methods is to refine ferrite grain size. A small ferrite grain size is desirable as this results in a steel with improved strength and toughness.

In recent years, there have been several reports in the scientific literature of different techniques for producing low carbon microalloyed steels with ultra fine ferrite grains. One type of approach has relied upon the expectation that dynamic recrystallisation at temperatures only a little above the austenite to ferrite transformation temperature ($Ar_3$) will produce a small grain size. Controlled rolling schedules have thus been devised, using laboratory simulation by torsion or compression testing, which exploit dynamic recrystallisation after strain accumulation.

In one case, Kaspar et al reported production of austenite grains down to 1 to 4 micron in a compression tested Nb-V microalloyed steel which transformed on cooling to ferrite with a mean grain size less than 5 micron ["Thermec 88" Proc.Int.Conf. on Physical Metallurgy of Thermomechanical Processing of Steels and Other Metals, I.S.I.J. 1988, 2, 713]. Samuel et al reported that torsion testing of niobium microalloyed steels produced austenite and ferrite grain sizes of 5 and 3.7 micron, respectively, in deformation schedules where strain accumulation from successive passes led to dynamic recrystallisation [I.S.I.J. Int., 1990, 30, 216].

U.S. Pat. No. 4,466,842 to Yada et al describes a hot-rolled ferritic steel composed of 70% or more of equiaxed ferrite grains having an ultra-fine grain size of 4 $\mu$m or less. This steel is produced by hot working at approximately the $Ar_3$ point and by one or more passes of hot working having a minimum required total reduction ratio of at least 75%. Due to hot working, dynamic transformation of austenite and/or dynamic recrystallisation of ferrite takes place.

For plain carbon steels, Matsumura and Yada [I.S.I.J. 1987, 27, 492 and "Thermec 88" I.S.I.J. 1988, 1, 200] disclosed hot working schedules using laboratory compression and rolling tests to produce ferrite grain sizes below 3 micron. By imposing large strains just above the $Ar_3$, they induced transformation during the deformation (despite the increase in temperature from the heat of deformation) and then continued to work the ferrite sufficiently for it to recrystallise dynamically. Rapid quenching after the deformation, while preventing coarsening of the ferrite grains, led to some martensite formation. By imposing strains up to 4, microstructures with 70–80% ferrite as fine as 1 to 2 micron were produced. Reducing the amount of intercritical deformation tended to reduce the volume fraction of ferrite and to increase the mean grain size.

Other techniques to produce ultrafine grains have been more involved. Ameyama et al. ["Thermec 88", I.S.I.J. 1988, 2, 848] disclosed low temperature deformation and brief austenitising cycles, combined with the addition of 3% Mn and 1% Mo to enhance austenite nucleation on reheating, to produce austenite grain sizes down to 1 micron in diameter. Kurzydlowski et al. [Z. Metallkunde, 1989, 80, 469] also disclosed repeated cold deformation and anneal cycles, together with boron additions, to produce austenitic stainless steels with grain sizes down to 1 micron diameter. Although these methods are of considerable scientific interest, they are a relatively expensive means of producing ultrafine grains.

More recently, Beynon et al have reported [Materials Forum 1992, 16, 37] the production of ultrafine Nb microalloyed ferrite, with an average grain size of approximately 1 micron, using laboratory hot torsion tests. The tests utilised controlled hot deformation at a temperature of about 1050° C., followed by rapid cooling through a sequence of six to eight finishing deformations, starting at 900° C. Each deformation was to a strain of 0.3 at an equivalent uniaxial strain rate of 2.3/s, and the final deformation was close to $Ar_3$, when maximum refinement was observed. The finest structure produced was a uniformly fine equiaxed ferritic microstructure with approximately 5% pearlite and a mean grain size for the ferrite of 1.3 micron. It was proposed that the refinement was due to strain induced transformation of a heavily controlled rolled initial austenite microstructure, in which the deformation increases the density of the nucleation sites for transformation to ferrite. Such a mechanism of ferrite refinement had been reported in the Matsumura and Yada paper first listed above. Priestner ["Thermomechanical Processing of Microalloyed Austenite", Met.Soc.A.I.M.E., 1981, 455] also obtained fine grains in regions of laboratory rolled samples which transformed in the roll gap during rolling. Again a large strain was necessary and the transformed product was mixed and quite "patchy", with some very large grains present. The processes reported by Beynon et al and by Priestner are again of scientific rather than practical interest.

It is a first preferred object of the invention to provide a practical process for the production of steels with ultrafine microstructures in any of a variety of phases or mixtures of phases, including eg bainite.

It is a second preferred object of the invention to provide a practical process for the production of steels with ultrafine ferrite microstructures.

It is a third preferred object of the present invention to provide a steel with an ultrafine microstructure, particularly an ultrafine ferrite microstructure.

It is a fourth preferred object of the present invention to provide apparatus for use in the production of steels with ultrafine ferrite microstructure.

SUMMARY OF THE INVENTION

The present invention stems from an initial surprising discovery that an austenite to ferrite transformation which achieves ultrafine ferrite grains can be achieved by the single deformation of a steel having large austenite grains, e.g. greater than 80 micron. This is quite contrary to the normal expectation that the smaller the size of the ferrite grains sought in the end product, the smaller the size of the austenite grains required prior to the transformation. The invention is not just perceived in terms of the specific context of this discovery. Rather, it is more broadly appreciated that steels with ultrafine ferrite grains may be produced by altering the transformation from one which normally proceeds with grain boundary nucleation followed by intragranular nucleation at deformation bands and other defects, to one which induces a substantially instantaneous transformation to ferrite homogeneously over the austenite grain. This is favoured, for example, by a reduction or minimisation of grain boundary nucleation of the ferrite grains prior to or during the transformation. Enlargement of the austenite grain size is of course one means of reducing grain boundary nucleation since it entails reduction of grain boundaries, but other methods may be employed.

It has also been appreciated that when a partially cooled austenite phase steel is deformed in a single pass in a temperature in the range for example of 700 to 950° C., the transformation to ferrite does not occur prior to deformation, as would conventionally be expected, but instead takes place rapidly during or immediately following the deformation.

It has also been appreciated that an austenite to ferrite transformation which achieves ultrafine ferrite grains can be achieved by austenitising a steel to a large grain size and then partially cooling and deformation treating the steel in the austenite phase. This is quite unexpected given the conventional wisdom that the reheating of a steel to give a coarse austenite grain size phase will then result in a coarse ferrite grain size after transformation on cooling.

It has further been found that the invention is not confined to the production of an ultrafine ferrite microstructure but is able to produce ultrafine microstructures in any of a variety of phases or mixtures of phases, including e.g. bainite.

The invention accordingly provides, in a first principal aspect, a method of producing a steel having one or more zones of ultrafine microstructure comprising treating an austenite phase steel before any substantial transformation has commenced so as to induce a rapid substantially complete transformation to an ultrafine microstructure in one or more zones of the microstructure.

In a second principal aspect the invention comprises a method of producing a steel having one or more zones of ultrafine microstructure comprising heating a steel to austenitise the steel, pre-cooling the austenite phase steel, treating the austenite phase steel before any substantial transformation has commenced so as to induce a rapid substantially complete transformation to an ultrafine microstructure in one or more zones of the microstructure.

The pre-cooling of the austenite phase steel is preferably by natural air, forced air or water cooling at a rate in the range 50 to 2000 K/min.

In a third principal aspect the invention comprises a method of producing a steel having one or more zones of ultrafine microstructure comprising partially pre-cooling freshly cast austenite phase steel, treating the austenite phase steel before any substantial transformation has commenced so as to induce a rapid substantially complete transformation to an ultrafine microstructure in one or more zones of the microstructure.

As employed herein, the term "austenite phase steel" refers to a steel which is in the austenite phase. It is appreciated that some steels, such as freshly cast steel, may have a number of other phases formed therein prior to reaching the austenite phase.

Preferably, the treatment applied to the austenite phase steel is a deformation performed at a temperature in the range of 600° C. to 950° C., more preferably 700° C. to 950° C. for a low carbon steel.

In a fourth principal aspect the invention comprises a method of producing a steel having one or more zones of ultrafine microstructure comprising deforming an austenite phase steel before any substantial transformation has commenced to so develop a predetermined strain profile or strain gradient across the structure of the steel so as to induce a rapid substantially complete transformation to an ultrafine microstructure in one or more zones of the microstructure.

Preferably, the zone of the ultrafine microstructure comprises a whole cross-section of the structure, most preferably a uniform ultrafine microstructure. In an alternative embodiment, the zones of the ultrafine microstructure may comprise a surface layer or layers of the steel. For the latter purpose, in the fourth aspect of the invention, the predetermined strain profile may comprise a relatively higher strain in a surface layer or layers of the steel and a relatively lower strain in the core. The transformation to the ultrafine microstructure then tends to occur in the surface layer or layers. This strain inhomogeneity can be enhanced by having friction conditions existing between the surface of the steel being rolled (ie the strip surface) and the roll. Alternatively, in the fourth aspect, by manipulating the coefficient of friction between the surface of the steel being rolled and the roll, a steel may be achieved in which a whole cross-section of the structure is transformed to an ultrafine microstructure, preferably a substantially uniform ultrafine microstructure.

In this context, the term "strain profile" preferably refers to an effective strain profile, where the effective strain encompasses the combined effect of shear strain due to the contact between the strip and the roll, and the compressive strain which relates to the simple reduction in thickness.

The deformation applied to the austenite phase steel, as with other aspects of the invention advantageously comprises deformation rolling. The rolling speed is preferably in the range 0.1 to 5.0 m/s. To develop the preferred strain profile the ratio of rolling arc ($L_d$) to nip gap or rolling thickness ($H_m$) is preferably greater than 10.

As employed herein, the term "rapid substantially complete transformation" indicates 90% transformation to the final ultrafine microstructure within the deformation zone or within one second of departure therefrom. In the case of a ferrite product, it will be understood that the transformation to ferrite is a rapid substantially complete transformation, whereas the carbide (cementite) formation may occur over a longer time frame. In the case of a bainite product, the entire transformation may occur in the deformation zone or within one second of departure therefrom.

The deformation in any of the first, second, third or fourth aspects of the invention preferably includes, and most preferably solely comprises, passing the steel between a pair of contra-rotating rolls effective to reduce a thickness dimension of the steel by a proportion in the range 20 to 70%, most preferably 30 to 60%, to a value defined by the loaded nip between the rolls. Preferably, only a single deformation of the steel is performed, eg a single pass of the steel between a pair of contra-rotating rolls. With rolls, the aforementioned deformation zone comprises the arc of contact between the steel and the rolls, terminating at the nip. The roll geometry, e.g. the rate of rolling, or roll diameter relative to steel thickness, may be selected to optimise said rapid substantially complete transformation. There may of course be further roll treatments prior to or subsequent to the transformation, but it is preferred that, prior to the deformation, the austenite phase steel has not been worked or has been worked only lightly.

Preferably, the deformation induces a largely homogenous transformation to an ultrafine microstructure. The transformation preferably occurs mostly during the deformation process, although some transformation may take place soon after the deformation. The transformation to the ultrafine microstructure is preferably complete within one second after the deformation. This transformation process is being called a "strain induced transformation".

In accordance with the second aspect of the invention, the steel is preferably heated to a temperature between 1000° C. to 1400° C., most preferably in the range 1100° C. to 1300° C.

Preferably, in each of the first, second, third and fourth aspects the steel is cooled after the transformation.

The ultrafine microstructure may comprise, for example, ultrafine predominantly ferrite grains, or, by way of further example, it may be a bainite microstructure.

Preferably, the austenite phase steel has a mean austenite grain size greater than 50 micron, more preferably greater than 80 micron. The austenite grain size in traditional hot rolled steel prior to transformation is around 40 micron. The austenite phase steel may be equiaxed.

In addition to, or instead of the austenite phase steel having an austenite grain size in the aforementioned preferred range, the steel may be pretreated in a manner effective to reduce or substantially eliminate grain boundary nucleation of ferrite grains, whereby to facilitate said rapid transformation. Such pretreatment may comprise a pretreatment to enlarge the mean austenite grain size of a selected steel or may alternatively or additionally comprise a chemical treatment, for example the addition of a component (e.g. boron) selected to reduce grain boundary reactivity. The pretreatment may advantageously entail a pre-cooling of the steel from a higher temperature, for example in the range 1000 to 1400° C., to the aforesaid temperature range, 600° C. to 950° C.

It is thought that the cooling of the transformed steel need not be particularly rapid and thus may be effected by forced air cooling, for example to produce a cooling rate up to 500° K/min, preferably between 50 and 2000° K/min. Of course, the invention does not preclude a slower or more rapid cooling if this proves to be beneficial. A particular embodiment of the invention may involve back spraying of cooling fluid into the roller nip to modify the grain size, e.g. the ferrite grain size, at the surface of the transformed steel.

The steel subjected to the deformation is preferably steel strip, plate, sheet, rod or bar, although the invention is also applicable to other steel forms, e.g. billet or slab. The strip, plate, sheet, rod or bar is preferably of a thickness less than 20 mm, most preferably less than 10 mm. It is thought that the invention is primarily applicable to produce what is conventionally regarded as thin strip (<5 mm) because it is in such strip that the distribution of the ultrafine microstructure can be optimised.

In a fifth principal aspect, the invention provides a steel with an ultrafine microstructure, for example having ultrafine ferrite grains, which is uniform and at least partially ultrafine in one or more zones and has a mean grain size no greater than 3 micron in these zone(s). Preferably, the steel has a mean grain size at the centre≦10 micron and in the surface layer(s)≦2 micron. Most preferably, a substantial proportion of the volume of a ferrite grain microstructure, for example at least 30%, may contain ferrite grains primarily of a size less than 3 micron. The microstructure of the steel may be layered, for example a surface layer or layers having zones of ultrafine microstructure, and a core layer of relatively coarse microstructure. Preferably, in this layered microstructure, at least 80% by volume of the fine grained layer contains grains primarily of a size less than 3 micron.

The deformation temperature may be selected in accordance with the desired end product steel specification, e.g. a higher deformation temperature for a softer steel.

Typically, said deformation will be accompanied by some cooling of the steel, for example by providing a conduction path for heat. This might be enhanced in the known manner by the use of lubricant and/or positively cooled rolls.

Preferably, where the product steel is a ferrite phase, the transformation to ferrite is such as to produce a microstructure in which the mean ferrite grain size at the centre of the steel is no more than 10 times the mean grain size in the surface layer.

The ultrafine microstructure is typically equiaxed, but this is not of course essential.

The steel may be pretreated eg by preheating and partial cooling to increase the proportion of grains which transform to said ultrafine microstructure.

The austenite phase steel is preferably a low carbon (C<0.3%) steel, and may be a low carbon microalloyed steel. However, higher carbon steels have also been shown to behave in the same manner, and can form ultrafine structures when processed according to this invention.

In a sixth principal aspect the invention comprises a combination casting and deformation apparatus for producing a steel having one or more zones of ultrafine microstructure comprising means to cast an austenite phase steel, means disposed to receive and partially pre-cool the freshly cast austenite phase steel, and means to treat the partially cooled steel before any substantial transformation has commenced so as to induce a rapid substantially complete transformation to an ultrafine microstructure in one or more zones of the microstructure.

The casting means may be a thin slab or strip caster and the treatment means preferably includes rolling means, eg a single pair of contra-rotating rolls.

In a seventh principal aspect the invention comprises a deformation apparatus for producing a steel having one or more zones of ultrafine microstructure comprising means to heat the steel to the austenite phase, means to partially pre-cool the austenite phase steel, means to treat the partially cooled austenite phase steel before any substantial transformation has commenced so as to induce a rapid substantially complete transformation to an ultrafine microstructure in one or more zones of the microstructure.

Embodiments of the invention will now be described by way of example only, with reference to the accompanying drawings and examples in which.

Figure 1:
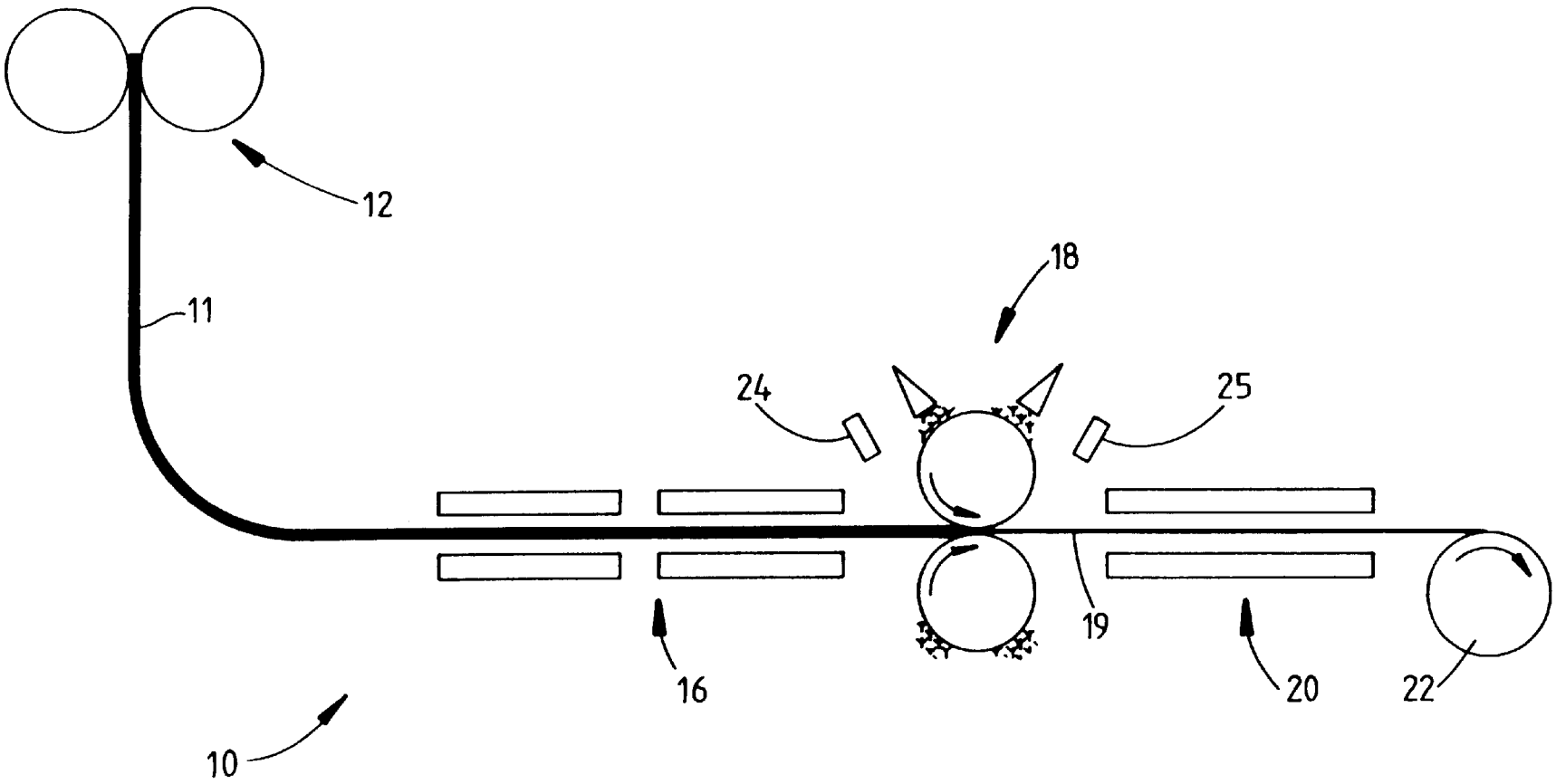
FIG. 1 is a simple diagram of a compact rolling line in accordance with an embodiment of the sixth aspect of the invention.

FIG. 1 is a simple diagram of a combination strip casting and rolling line 10 comprising one embodiment of the sixth aspect of the invention. Austenite phase hot steel strip 11 of gauge preferably less than 10 mm, emerges vertically downwardly from a strip caster 12, and is fed directly to a pre-cooler 16. Here, the steel is pre-cooled, by natural air, forced air or water cooling, to a temperature in the range 700 to 950° C. Still austenite phase, the strip is now presented for a single pass 50% reduction at a roll stand 18 to so strain the steel as to induce rapid substantially complete transformation. The transformed rolled strip 19, half its former thickness, is now passed through a natural air, forced air or water cooler 20 to cool it to ambient temperature, or to a selected intermediate temperature. The ultrafine grain steel strip is then gathered onto a coiler 22. Surface temperature of the steel before and after the deformation zone, defined by the arc of contact at the rollers, is monitored by respective pyrometers 24,25.

Figure 2:
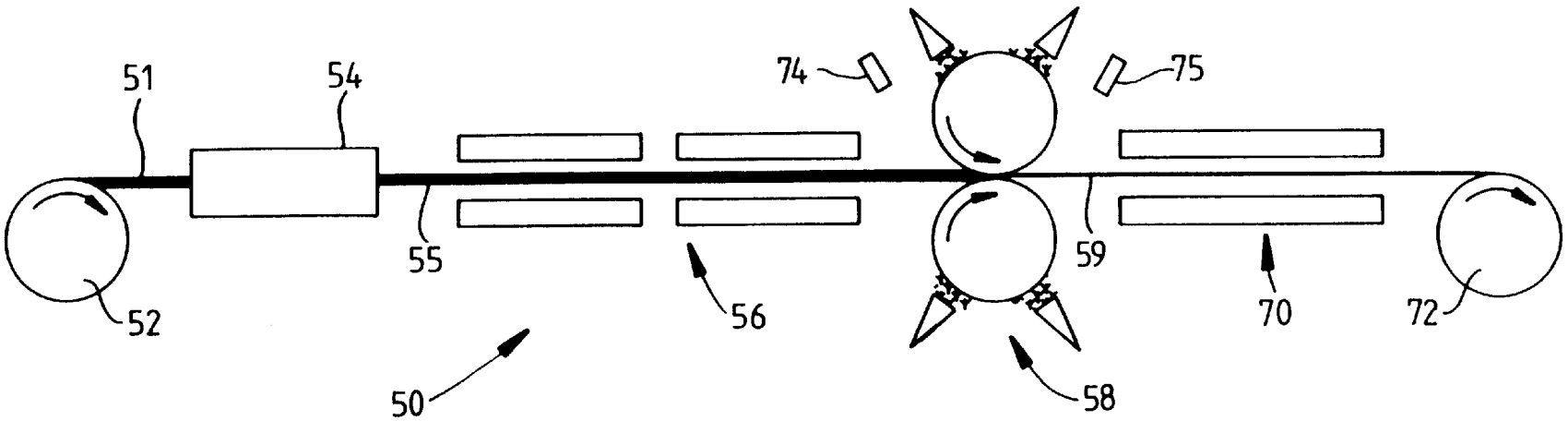
FIG. 2 is a simple diagram of a combination strip reheating and rolling line in accordance with an embodiment of the seventh aspect of the invention.

FIG. 2 is a simple diagram of a compact rolling line 50 comprising one embodiment of the seventh aspect of the invention. Steel strip 51 of gauge preferably less than 10 mm is withdrawn from a coiler 52 and passed through a furnace e.g. a transverse flux induction furnace 54 in which the strip is heated past the austenite phase equilibrium temperature ($Ae_3$) to transform it to austenite. This austenite phase steel 55 is pre-cooled to a temperature in the range 700° C. to 950° C. in a natural air, forced air or water pre-cooler 56. Still austenite phase, the strip 55 is now presented for a single pass 50% reduction at a roll stand 58 to so strain the steel as to induce rapid substantially complete transformation. The transformed rolled strip 59, half its former thickness is now passed through a natural air, forced air or water cooler 70 to cool it to ambient temperature, or to a selected intermediate temperature. The ultrafine grain steel strip is then gathered onto a coiler 72. The surface temperature of the steel before and after the deformation zone, defined by the arc of contact at the rollers, is monitored by respective pyrometers 74,75.

Figure 3:
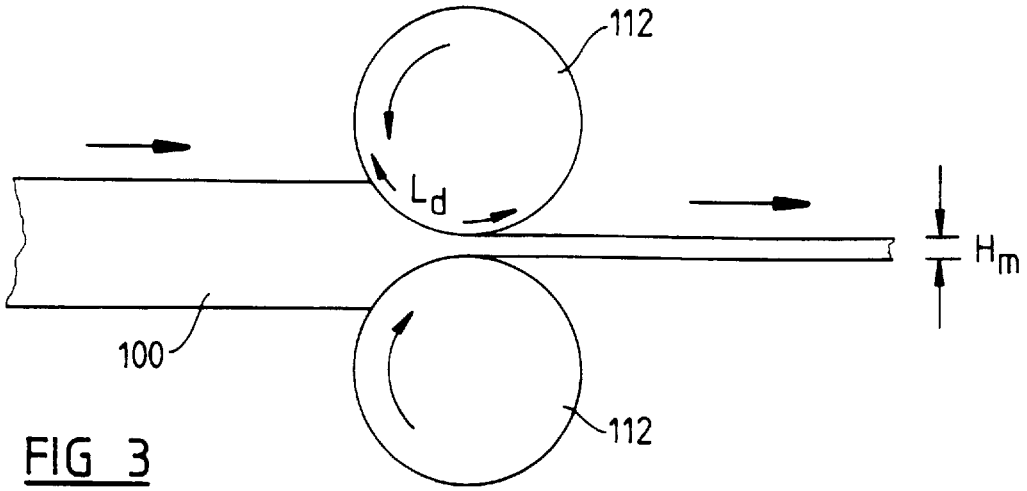
FIG. 3 is a simple diagram of a single pass rolling deformation used in an embodiment of the method of the fourth aspect of the invention.
Figure 4:
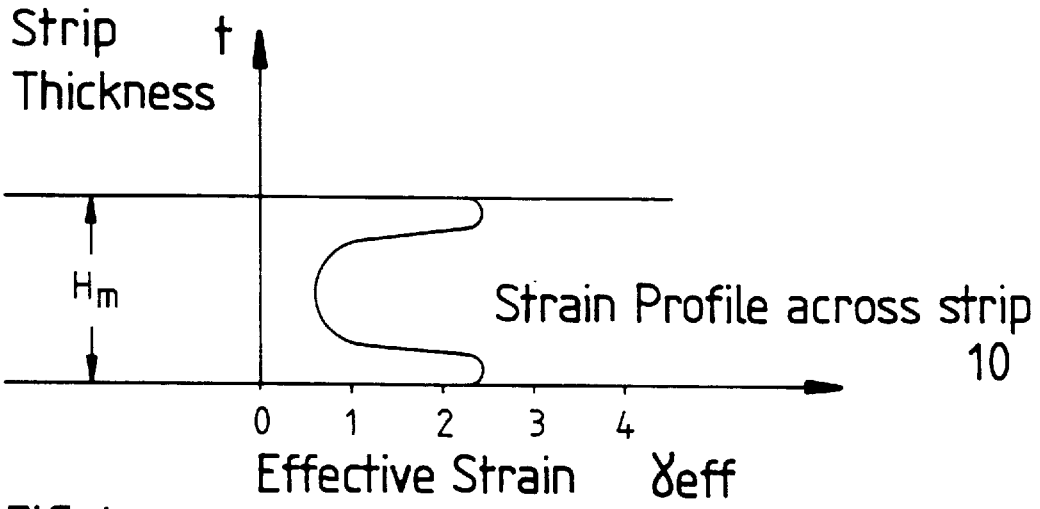
FIG. 4 is a diagram of an exemplary cross-sectional strain profile through the strip of FIG. 3.
Figure 5:
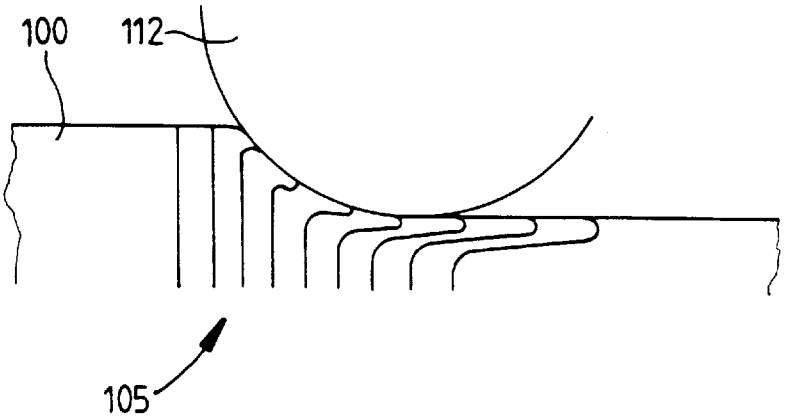
FIG. 5 illustrates the displacement of successive transverse segments of the microstructure of the strip shown in FIG. 3.
Figure 6:
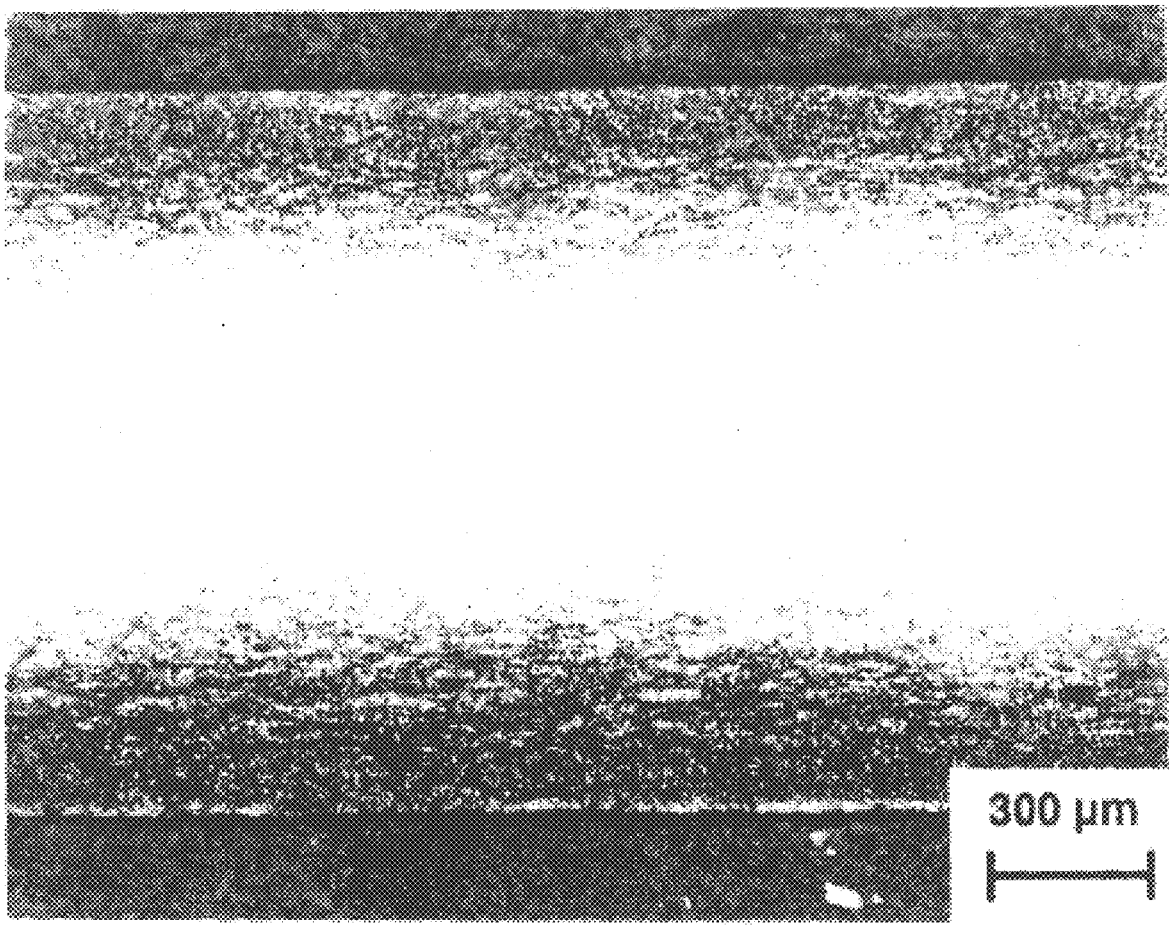
FIG. 6 is an optical micrograph showing the surface regions of ultrafine grains of a steel in accordance with an embodiment of the invention.

FIG. 3 diagrammatically depicts a cross-section of a single pass rolling deformation suitable for practising the fourth aspect of the present invention with a strip 100. The rolls are at 112 and FIG. 3 also indicates the aforementioned parameters $L_d$ and $H_m$. FIG. 4 is a diagram depicting an exemplary cross-sectional strain profile through the strip thickness of the general form preferred in accordance with this aspect of the present invention. The effective strain refers to the combined effects of the reduction strain, given by 1 n H/h where H is the strip thickness at the entry to the roll and h is the strip thickness at the roll exit, and the shear strain due to the friction conditions. FIG. 5 illustrates the displacement of successive transverse segments 105 of the metal in a longitudinal cross-section of the strip through the deformation zone at a given time point. FIG. 6 depicts a typical resultant layered microstructure (ie surface layers of predominantly ultrafine microstructure and a core of relatively coarser microstructure). It will be seen that the width of the layers corresponds to the high strain surface zones indicated in FIGS. 4 and 5.

EXAMPLE 1

Low carbon steel strip (C 0.09%, Mn 1.47% Si 0.08% Nb 0.027% Ti 0.025%, the balance Fe plus typical levels of residue elements) at a surface temperature of 1250° C. and having observed austenite grain sizes primarily in the range 100 to 200 micron, was pre-cooled to a surface temperature of 800° C. by being left to naturally cool in air. The cooled strip, of 2.25 mm thickness, was deformation rolled, in a single pass through the nip of a pair of contra-rotating rolls, to cause a 38% reduction in thickness to 1.38 mm. The exit surface temperature of the steel strip from the rolls was 700° C. The strip was then left to cool in air to ambient temperature.

The ferrite grain size varied between <1 and 12 micron, and a substantial proportion of the total volume, about 60%, had grain sizes primarily in the range <1 to 3 micron. These ultrafine zones were concentrated at or close to the surface. From observation, it was found that the partially cooled steel presented to the nip was not already partially or wholly transformed, but was still substantially wholly austenite phase steel. Moreover, it was thought that the austenite to ferrite transformation occurred at or very close after the roller nip, suggesting that the mechanism was strain induced transformation. It was also observed that there was little or no tendency for the ferrite grains to thereafter coarsen despite the relatively slow rate of cooling inherent in natural air cooling, suggesting that the transformation was substantially instantaneous, whereby the grains were locked in position against expansion in size.

EXAMPLE 2

Low carbon steel strip (C 0.1%, Mn 1.38%, Si 1.4%, the balance Fe plus typical levels of residue elements) at a surface temperature of 1250° C. and having observed austenite grain sizes primarily in the range 100 to 200 micron, was pre-cooled to a surface temperature of 775° C. by being left to naturally cool in air. The cooled strip, of 2.13 mm thickness, was deformation rolled, in a single pass through the nip of a pair of contra-rotating rolls, to cause a 39% reduction in thickness to 1.3 mm. The exit surface temperature of the steel strip from the rolls was 688° C. The strip was then left to cool in air to ambient temperature.

The ferrite grain sizes varied between <1 and 20 micron, and a substantial proportion of the total volume, about 60%, had grain sizes primarily in the range <1 to 3 micron. These ultrafine zones were concentrated at or close to the surface. From observation, it was found that the partially cooled steel presented to the nip was not already partially or wholly transformed, but was still substantially wholly austenite phase steel. Moreover, it was thought that the austenite to ferrite transformation occurred at or very close after the roller nip, suggesting that the mechanism was strain induced transformation. It was also observed that there was little or no tendency for the ferrite grains to thereafter coarsen despite the relatively slow rate of cooling inherent in natural air cooling, suggesting that the transformation was substantially instantaneous, whereby the grains were locked in position against expansion in size.

EXAMPLE 3

Freshly cast steel as such was not readily available for the purposes of experimentation. However, a low carbon steel strip (C 0.07%, Mn 0.4%, the balance Fe plus typical levels of residue elements) at a surface temperature of 1250° C. was employed to simulate a freshly cast steel. The steel had austenite grain sizes primarily in the range 100 to 200 micron. The steel used differed from fresh cast steel in that the grain structure was equiaxed. The steel was pre-cooled to a surface temperature of 800° C. by being left to naturally cool in air. The cooled strip, of 1.8 mm thickness, was deformation rolled, in a single pass through the nip of a pair of contra-rotating rolls, to cause a 45% reduction in thickness to 1.0 mm. The exit surface temperature of the steel strip from the rolls was 680° C. The strip was then left to cool in air to 600° C., at which temperature it was held for an hour to simulate coiling, then left to cool in air to ambient temperature.

The product was found to be 95% ferrite, distributed uniformly in the strip. The ferrite grain sizes varied between 1 and 10 micron, and a substantial proportion of the total volume, about 60%, had grain sizes primarily in the range 1 to 2 micron. These ultrafine zones were concentrated at or close to the surface. From observation, it was found that the partially cooled steel presented to the nip was not already partially or wholly transformed, but was still substantially wholly austenite phase steel. Moreover, it was thought that the austenite to ferrite transformation occurred at or very close after the roller nip, suggesting that the mechanism was strain induced transformation. It was also observed that there was little or no tendency for the ferrite grains to thereafter coarsen despite the relatively slow rate of cooling inherent in coiling, suggesting that the transformation was substantially instantaneous, whereby the grains were locked in position against expansion in size.

The strip was tested in tension and found to have a yield strength of 460 MPa and an ultimate tensile strength of 480 MPa. The total elongation was 28% and the uniform elongation was 20%.

EXAMPLE 4

Low carbon steel strip (C 0.1%, Mn 0.86%, Si 0.29%, Nb 0.037%, the balance Fe plus typical levels of residue elements) at a surface temperature of 1250° C. and having observed austenite grain sizes primarily in the range 100 to 200 micron, was pre-cooled to a surface temperature of 800° C. by being left to naturally cool in air. The cooled strip, of 2.4 mm thickness, was deformation rolled, in a single pass through the nip of a pair of contra-rotating rolls, to cause a 40% reduction in thickness to 1.43 mm. The exit surface temperature of the steel strip from the rolls was 696° C. The strip was then left to cool in air to ambient temperature.

The ferrite grain sizes varied between 1 and 12 micron, and a substantial proportion of the total volume, about 60%, had grain sizes primarily in the range 1 to 2 micron. These ultrafine zones were concentrated at or close to the surface. From observation, it was found that the partially cooled steel presented to the nip was not already partially or wholly transformed, but was still substantially wholly austenite phase steel. Moreover, it was thought that the austenite to ferrite transformation occurred at or very close after the roller nip, suggesting that the mechanism was strain induced transformation. It was also observed that there was little or no tendency for the ferrite grains to thereafter coarsen despite the relatively slow rate of cooling inherent in natural air cooling, suggesting that the transformation was substantially instantaneous, whereby the grains were locked in position against expansion in size.

FURTHER EXAMPLES

A large number of low, medium and high carbon steels, from both production and laboratory melts, were rolled in a mill. The carbon contents of the steels ranged from 0.036 to 0.77% C, and their full compositions are shown in Table 1. The steels were initially roughed to 2 mm thick strips and cut into pieces about 100 mm wide and 150 mm long. The strips were reheated to 1250° C. for 10 to 15 minutes in stainless steel bags and then air cooled to the desired rolling temperature. Rolling was performed in a single pass, using rolls with a diameter of approximately 300 mm. Samples were then allowed to air cool, or coiling was simulated in a fluidised sand bed at constant temperature for 1 hour followed by cooling to room temperature between two kaowool blankets. The rolling entry and exit temperatures were recorded by a pyrometer at either side of the roll gap. The rolling entry and exit temperatures are shown in Table 2.

The effect of various processing parameters on the microstructure of the strips was investigated. In addition to the effect of carbon and other common alloying elements, the presence of microalloying elements such as Nb, Ti and B in some steels was expected to be influential on the final microstructure. The effect of roll entry temperature, reduction, roll speed, lubrication and feed thickness were also studied. Table 2 shows the range of experimental conditions investigated for all steels.

Metallographic samples were prepared from the rolled strips using standard techniques, and studied using both optical and scanning electron microscopy. Vickers hardness measurements were made and tensile specimens were prepared from some strips. Tensile tests were performed on a Sintech tensile machine at a strain rate of $10^{-4}$ $S^{-1}$.

MICROSTRUCTURES

The steels listed in Table 1 have been divided into plain and microalloyed low carbon grades, medium carbon and higher carbon grades. The general feature of all the rolled samples was the presence of an ultrafine microstructure, usually consisting of ferrite grains and discrete carbide particles in a region near the surface of the samples and a coarser microstructure in the centre regions. This ultrafine region generally penetrated to a depth of about ¼ to ⅓ of the sample thickness (FIG. 6). Individual microstructures are described in more detail below.

Temperature drops recorded at the exit of the rolling mill ranged from 70 to 180° C., although most were in the order of 70 to 100° C. Most reductions were between 30 and 40%.

PLAIN LOW CARBON STEELS

Four plain low carbon steels were rolled: M06, A06 and 3373 and 3398, with the majority of the experimental conditions being varied for M06 and A06.

M06

Figure 7A:
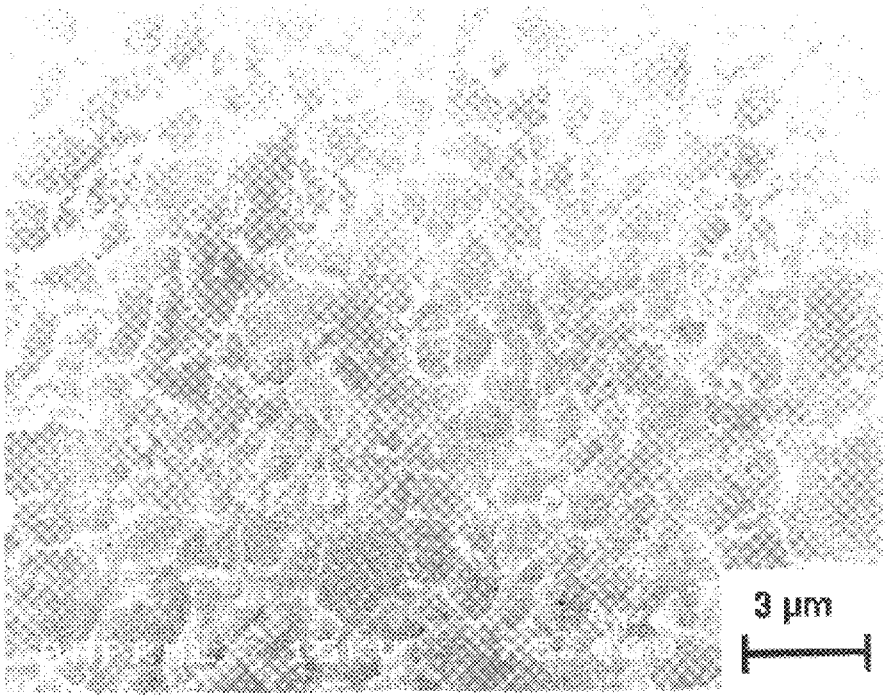
FIG. 7A is a scanning electron micrograph of ultrafine ferrite grains in surface regions of M06 steel strip.
Figure 7B:
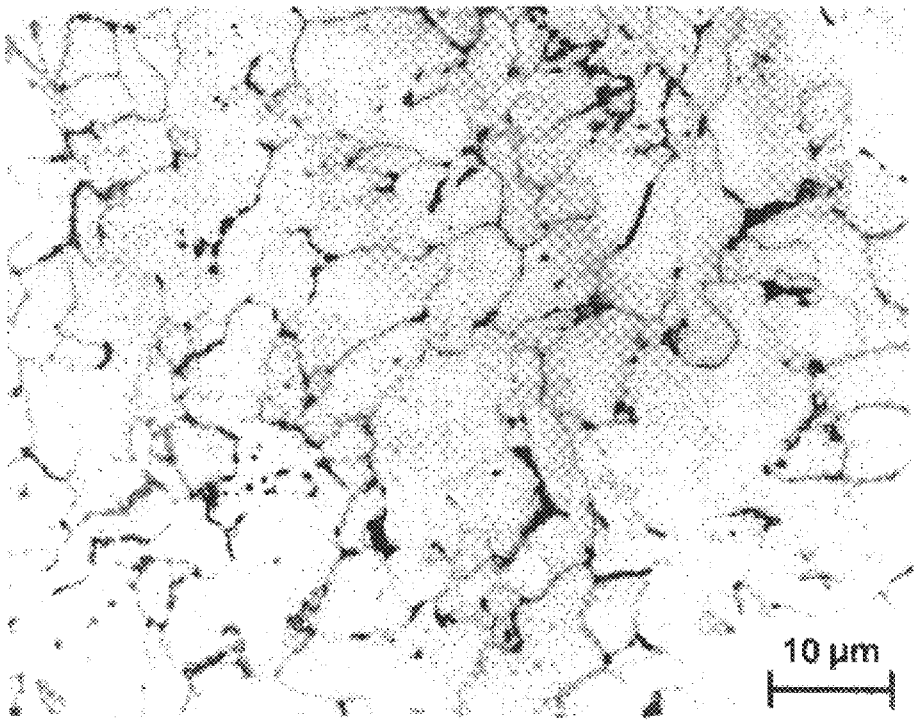
FIG. 7B is an optical micrograph of coarse ferrite grains in centre regions of M06 strip.
Figure 7C:
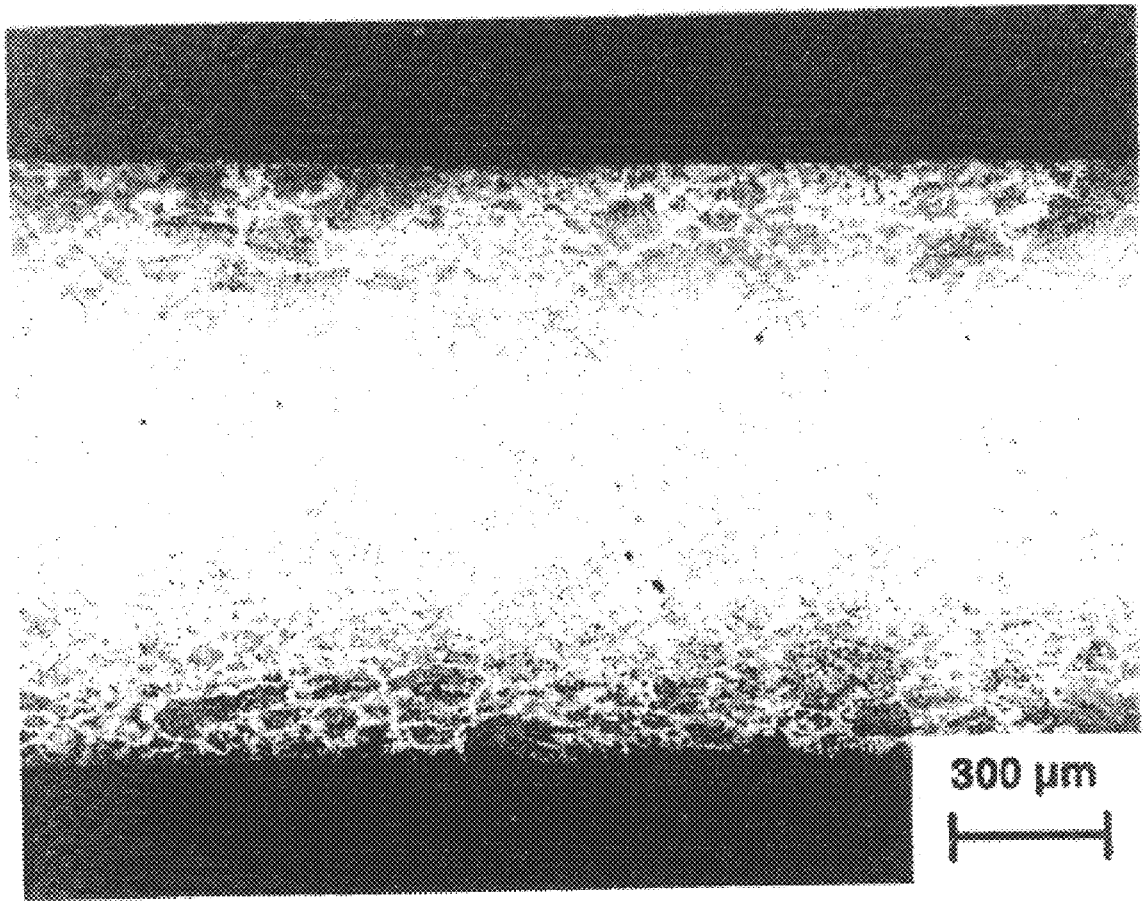
FIG. 7C is an optical micrograph of M06 sample rolled at low entry temperature.

The effect of roll entry temperature was considered by rolling four samples at delivery temperatures of 835, 795, 775 and 740° C. (samples M06-1, 2, 4 and 3 respectively). The first two conditions did not appear to significantly alter the microstructure, with a region of equiaxed ferrite of size 1–3 μm penetrating to about ¼ of the sample depth (FIG. 7A), and a centre region of coarser angular and equiaxed ferrite of size 5–15 μm (FIG. 7B). The third entry temperature resulted in the formation of some proeutectoid ferrite near the surface, possibly forming on prior austenite grain boundaries. There were, however, ultrafine ferrite grains near the surface as before and a coarse angular structure in the centre. The lowest delivery temperature produced a microstructure consisting of large amounts of proeutectoid ferrite throughout the sample (FIG. 7C).

Figure 8A:
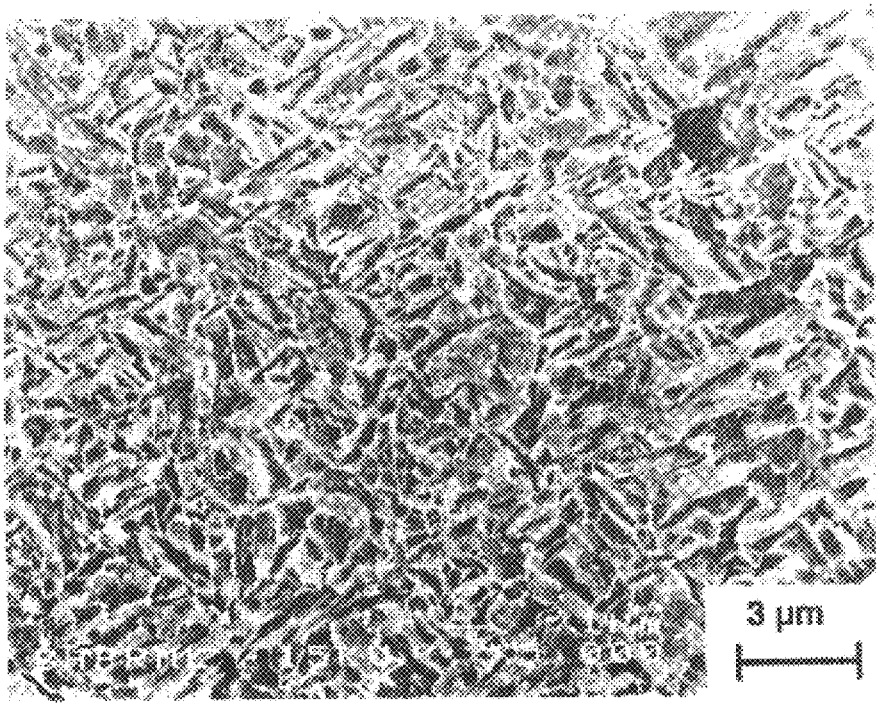
FIG. 8A is a scanning electron micrograph of ultrafine microstructure in surface regions of M06 strip rolled at low speed.
Figure 8B:
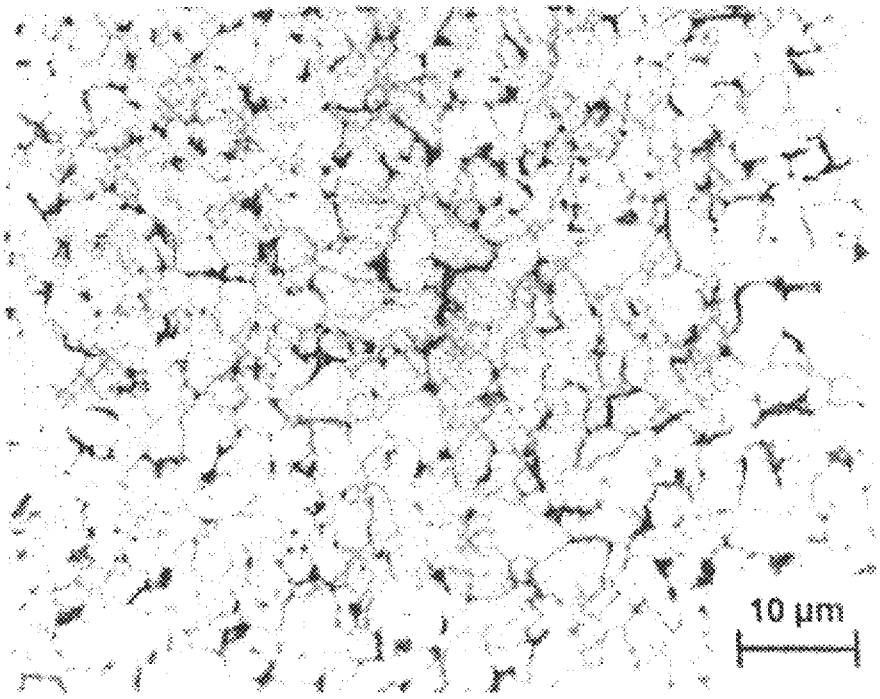
FIG. 8B is an optical micrograph of ferrite grains in surface regions of M06 strip rolled at high speed.

The effect of roll speed was considered by comparing speeds of 0.18, 0.27, 0.37 (standard speed) and a 1.0 m/s. The slower roll speeds (M06-5 and 6) resulted in a considerably greater temperature loss in the roll gap due to greater contact times with the cold rolls. This produced more proeutectoid ferrite than for the standard roll speed at a similar entry temperature (M60-4). At a roll speed of 0.18 m/s, a completely different microstructure was produced. Both the centre and surface of the sample consisted of an ultrafine bainitic type microstructure which was highly crystallographic in nature (FIG. 8A). The surface laths were finer than those in the centre. Such a microstructure reflects the large temperature drop (about 170° C.) that occurred in the roll gap. The highest roll speed achieved was 1.0 m/s (M06-16) which resulted in a layered structure, although the ferrite grains in the surface regions were not ultrafine (FIG. 8B).

Figure 9A:
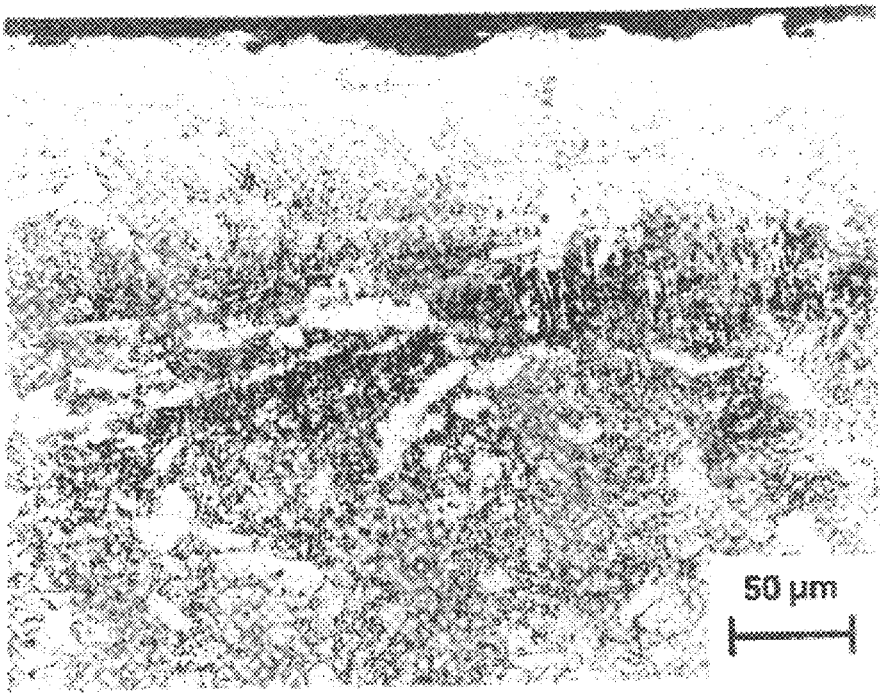
FIG. 9A is an optical micrograph of surface region of M06 rolled with lubrication.
Figure 9B:
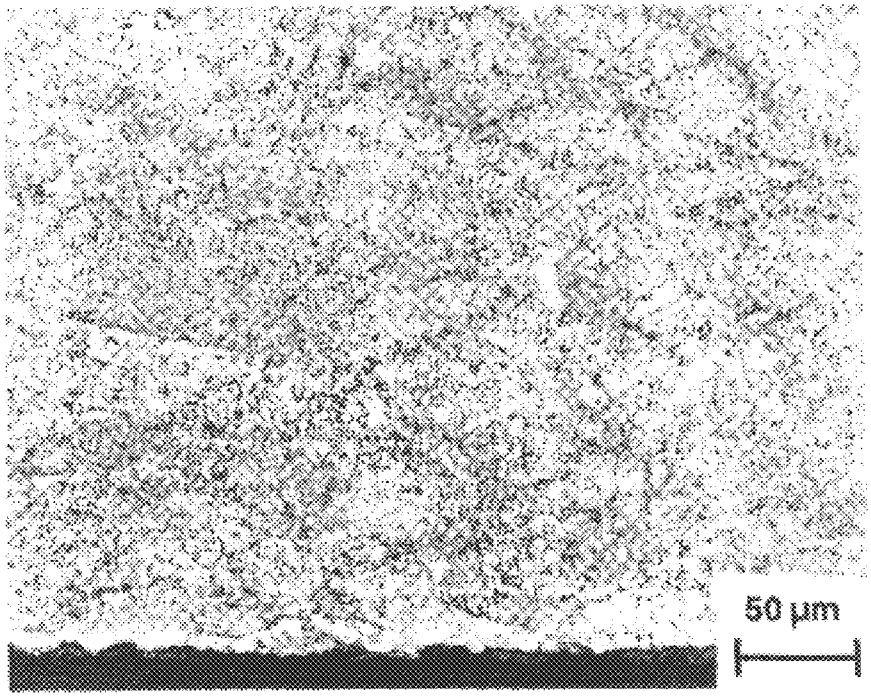
FIG. 9B is an optical micrograph of surface region of M06 rolled without lubrication.

Five samples were rolled using a boron nitride spray lubricant on the rolls. One sample (M06-8) rolled at 790° C. was reduced 57% and consisted of large amounts of proeutectoid ferrite throughout the sample and a phase which appeared as an ultrafine bainite, similar to that observed from M06-5. A second sample (M06-10) was rolled at only a slightly higher temperature but reduced only 41%. This sample was not quenched by the rolls to the same degree as the sample M06-5. It consisted of a small amount of proeutectoid ferrite, together with a relatively shallow ultrafine (1–3 μm) ferrite region and a coarse (5–15 μm) angular ferrite centre. Samples M06-18 and 19 were rolled with lubricant at 800 and 775° C. and again produced slightly different structures, with more severely quenched surface regions and less proeutectoid ferrite. These differences may be due to a variation in lubricant thickness. The application of lubricant to one roll only (M06-17) resulted in a quenched microstructure near the lubricated surface and a relatively fine ferrite structure at the opposite surface (FIG. 9). There was little increase in reduction compared with an unlubricated sample (FIG. 9B). Two scaled (ie not reheated in bags) samples were rolled (M06-21 and 22) and resulted in relatively coarse equiaxed ferrite surface grains (up to 10 μm) and coarse centre regions (10–20 μm). The scale was expected to act as a lubricant and although it slightly decreased roll loads and increased total reduction, the presence of scale did not produce structures similar to those rolled with the lubricant sprayed onto the rolls. The scale did however act as an insulator and reduced the temperature drop to around 40° C.

Figure 10A:
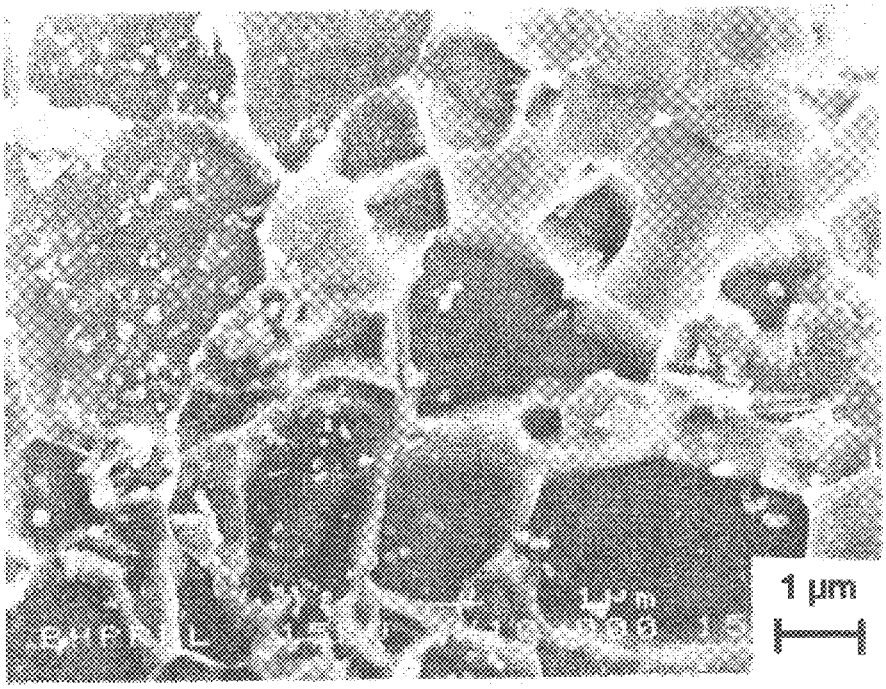
FIG. 10A is a scanning electron micrograph showing carbide distribution in surface regions of M06 after air cooling.
Figure 10B:
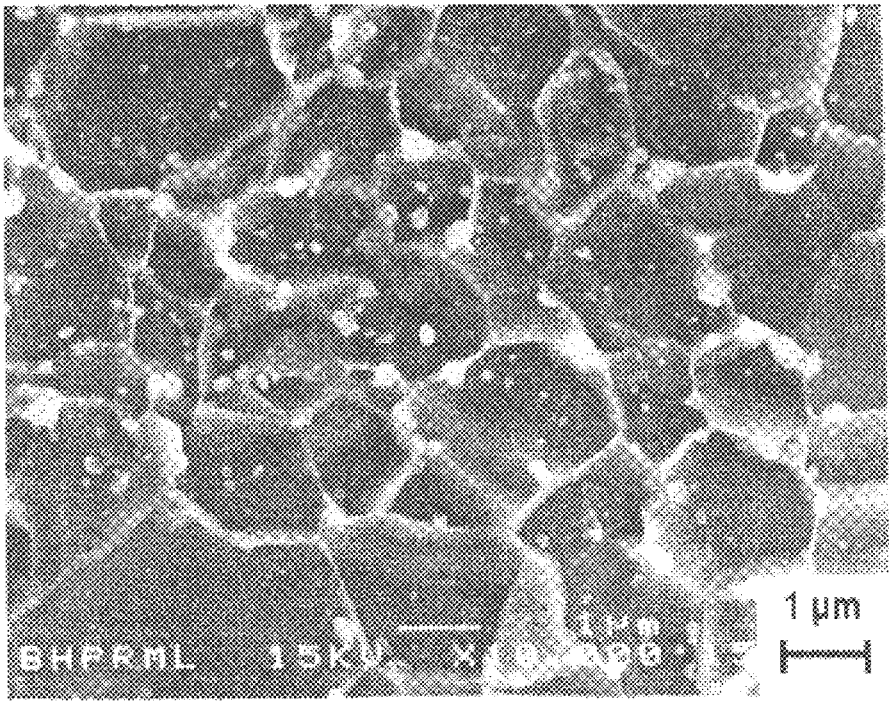
FIG. 10B is a scanning electron micrograph showing carbide distribution in surface regions of M06 after coiling at 650° C.

The final condition varied for the M06 material was the effect of coiling the rolled strip in the fluidised sand bed (M06-15). There was no apparent change in the surface or centre grain size of sample M06-15, although the carbide distribution was altered by the coiling process (FIG. 10A). It appears that there is a greater proportion of carbides at the grain boundaries and triple points in the sample that has been coiled (FIG. 10B).

A06

Conventional A06 was rolled under similar conditions to M06, although the reheat temperature was reduced in some cases. In general, microstructures similar to M06 were obtained, although there was more variation through the thickness and in the direction of rolling.

Roll entry temperature was varied for samples A06-1, 2, 3 and 8. The highest entry temperature of 905° C. was employed for A06-8 and resulted in a reasonably equiaxed structure, with 1 to 4 μm grains near the surface and coarser grains, up to about 15 μm, in the centre region. A delivery temperature of 855° C. for A06-2 produced a region of equiaxed ferrite of similar depth to sample A06-8, together with a centre consisting of coarse, angular ferrite grains of various orientations, often greater than 20 μm in length. Decreasing the entry temperature by 50° C. (A06-1) produced a similar structure, although there was the appearance of some proeutectoid ferrite. The lowest rolling temperature of 755° C. (A06-5) produced large amounts of coarse proeutectoid ferrite, although the ultrafine surface bands remained.

Roll speed was investigated as a process variable and a similar trend to M06 was observed. A low roll speed of 0.18 m/s (A06-4) produced a similar structure to the sample rolled at the same temperature (A06-1), although the temperature drop was over 100° C. greater and considerable proeutectoid ferrite was produced. An intermediate speed of 0.27 m/s resulted in an overall coarser microstructure, although this sample (A06-7) was rolled at a higher temperature.

Reducing the reheat temperature to 1050° C. for samples A06-5 and 6 significantly reduced the volume fraction of ultrafine grains in the surface regions and increased the coarseness of the centre grains. The sample rolled at the higher entry temperature (A06-5) had regions of ferrite grains less than about 4 μm in size, but these regions were isolated and not situated directly near the surface. A lower delivery temperature (A06-6) produced far fewer regions of ultrafine ferrite, and there were very coarse, angular grains throughout the whole microstructure, extending even to the surface. There was also some evidence of warm worked ferrite grains.

3373

Figure 11A:
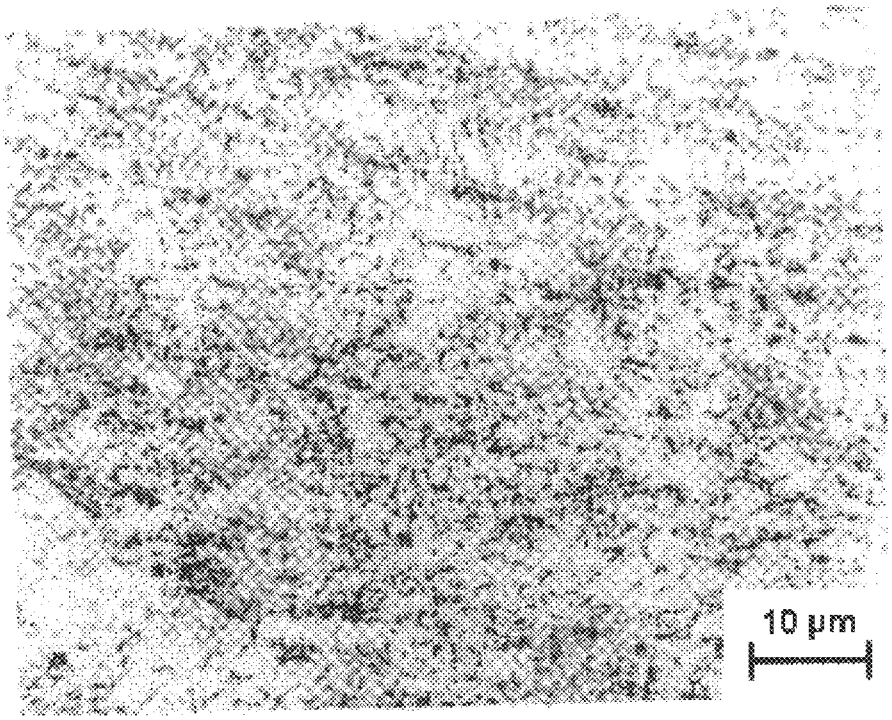
FIG. 11A is an optical micrograph showing ultrafine ferrite and carbide distribution in surface regions of 0.065 C–0.99 Mn steel (3373)
Figure 11B:
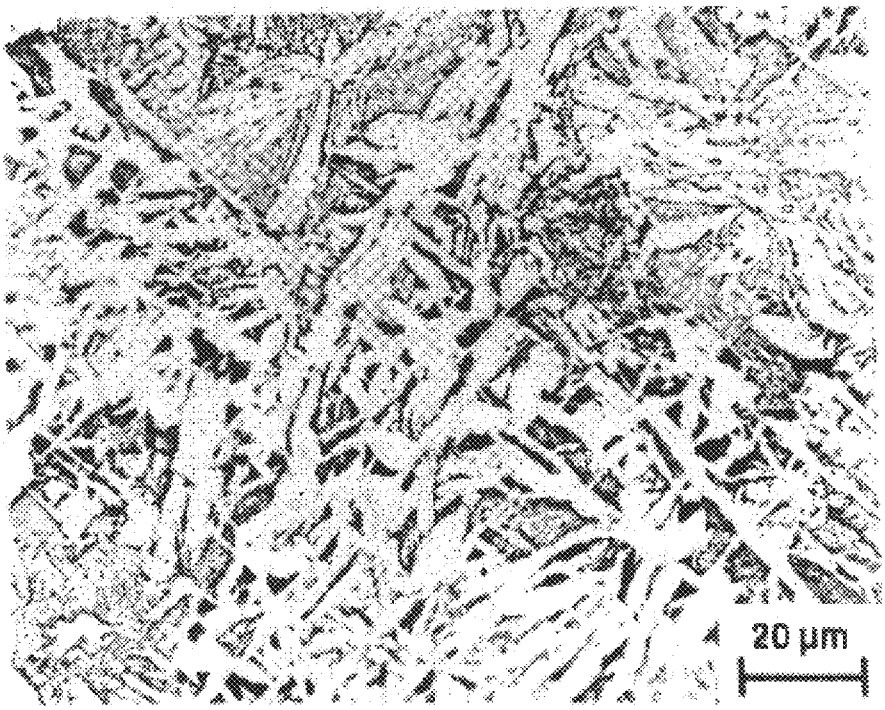
FIG. 11B is an optical micrograph showing acicular ferrite in centre regions of 0.065 C–0.99 Mn steel (3373)

The microstructure of this grade (0.065% C-1% Mn) consisted of a surface layer of ultrafine ferrite grains (1–2 μm) penetrating to about ¼ of the sample depth (FIG. 11A), with regions of segregated carbides which appeared to be aligned in rows. The centre (FIG. 11B) consisted of large volume fractions of course Widmanstätten or acicular ferrite, with evidence of a second phase, possibly pearlite.

3398

Figure 12A:
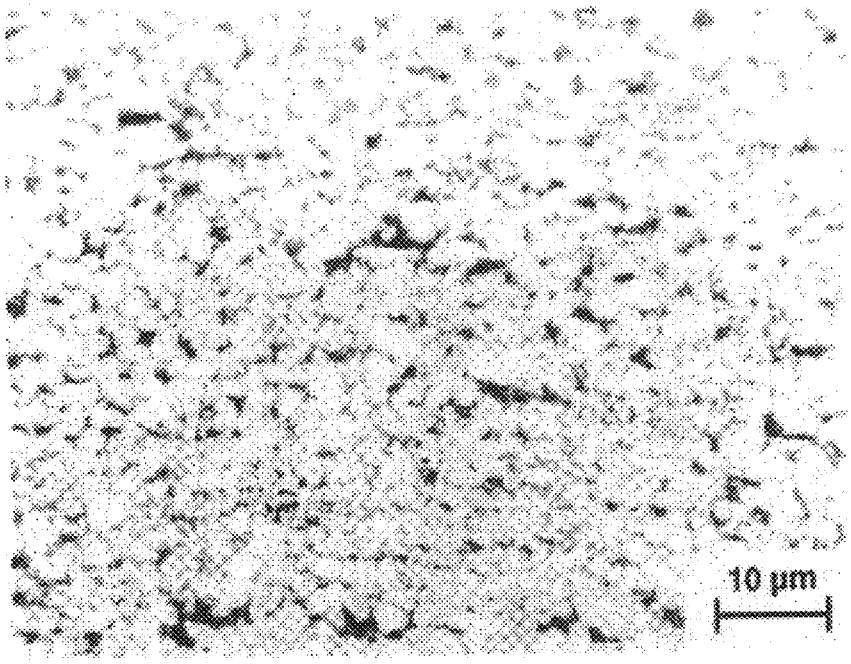
FIG. 12A is an optical micrograph showing ultrafine ferrite in surface regions of high SI steel (3398) after 1250° C. reheat.
Figure 12B:
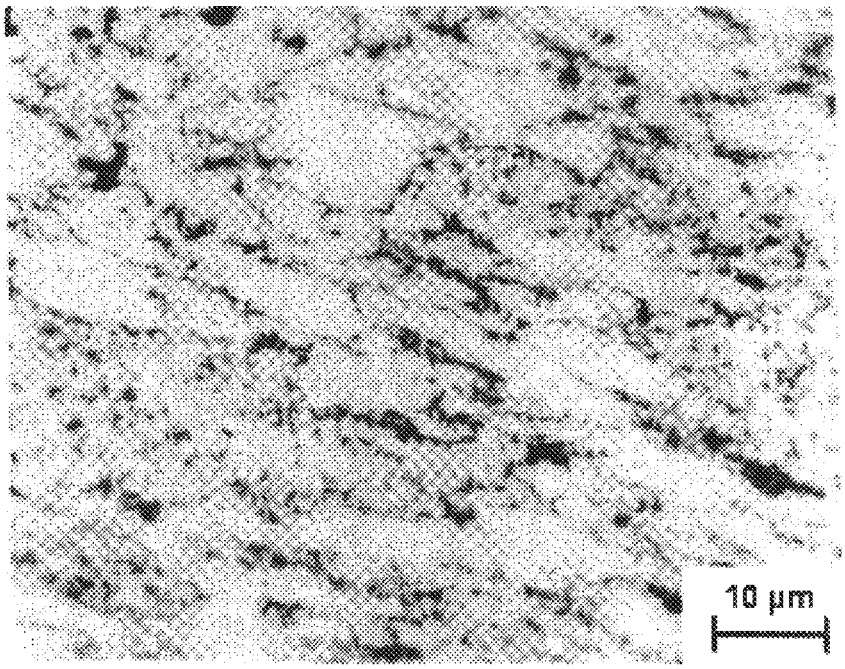
FIG. 12B is an optical micrograph showing worked ferrite in surface regions of high SI steel (3398) after 950° C. reheat.

This high Si grade provided some insight into the effect of prior austenite grain size, as determined largely by reheat temperature, on the final microstructure. A high reheat temperature of 1250° C. (FIG. 12A) resulted in a similar structure to that obtained in the 3373 heat, although the surface layers were not as fine overall and the centre consisted of coarser, more blocky ferrite grains, with some discrete martensite islands. Carbides were present at the ferrite grain boundaries and were continuous around a large percentage of ferrite grains. Reheating the sample to only 950° C. (3398-2) produced distinct surface and centre regions as before, however, the surface consisted of a mixture of ultrafine grains or sub-grains and large, worked ferrite grains (FIG. 12B). The centre consisted of reasonably equiaxed ferrite (about 5 to 10 μm) and discrete carbides and some small islands of martensite.

MICROALLOYED LOW CARBON STEELS

Ti Additions

Figure 13A:
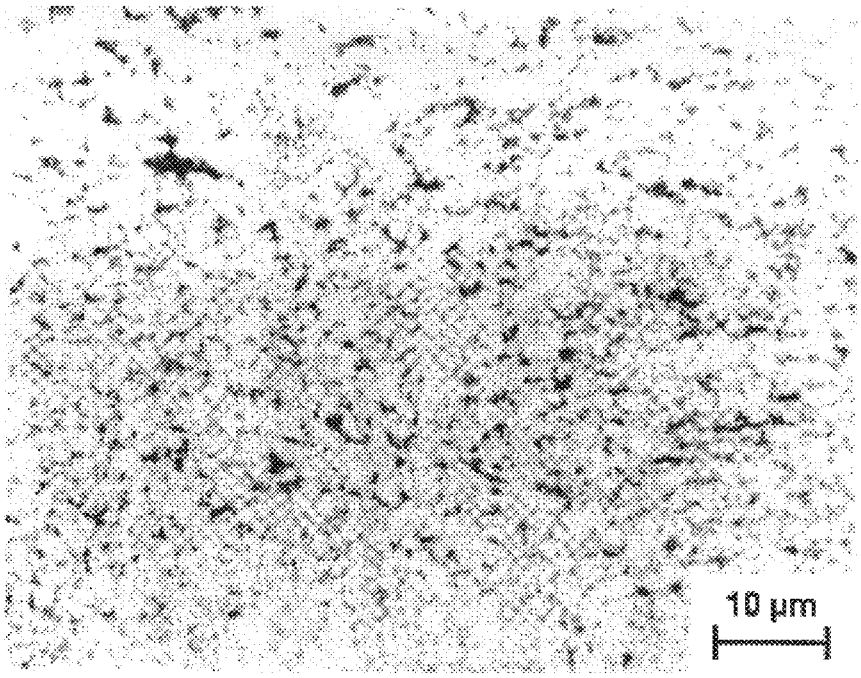
FIG. 13A is an optical micrograph showing ultrafine ferrite in surface regions of Ti microalloyed steel (3403)
Figure 13B:
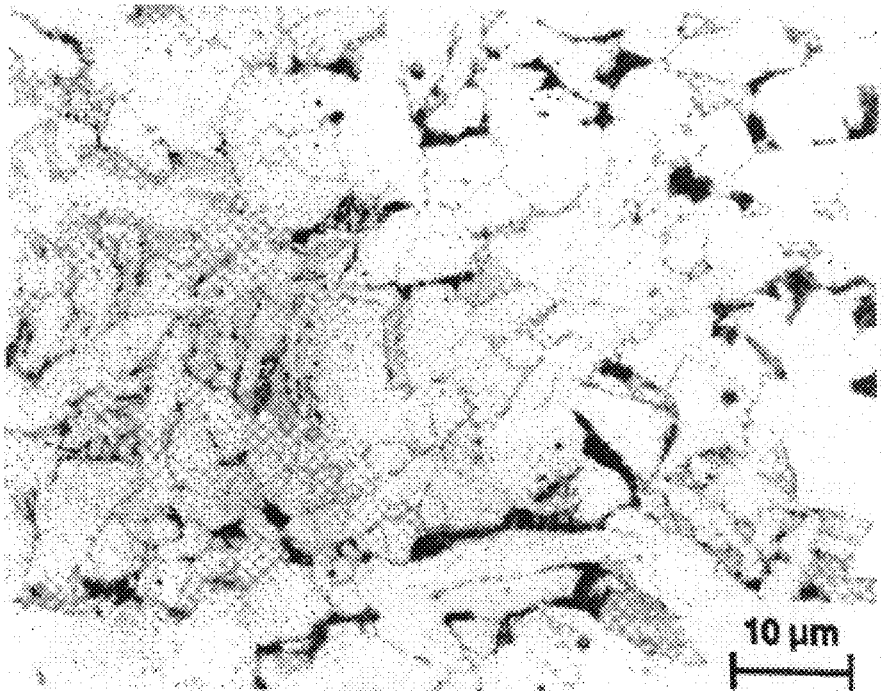
FIG. 13B is an optical micrograph showing coarse ferrite and martensite islands in centre regions of Ti microalloyed steel (3403)
Figure 14A:
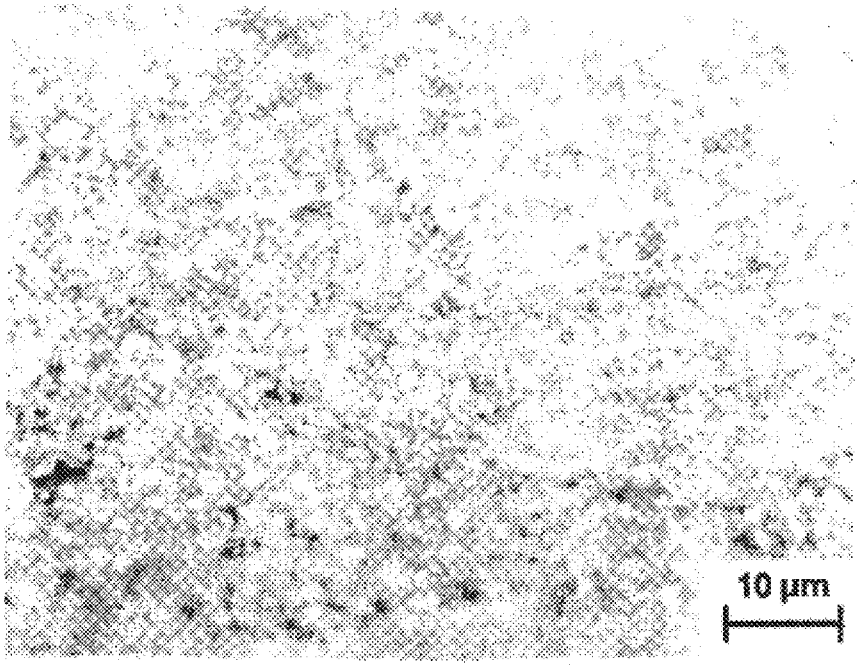
FIG. 14A is an optical micrograph showing ultrafine ferrite in surface regions of Ti-Mo microalloyed steel (3403)
Figure 14B:
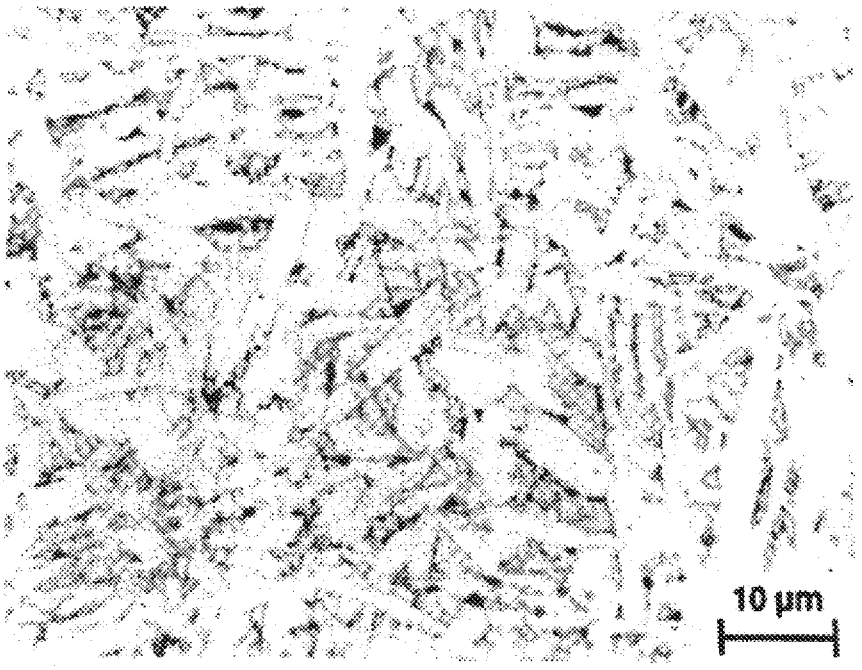
FIG. 14B is an optical micrograph showing acicular ferrite and martensite islands in centre regions of Ti-Mo microalloyed steel (3404)

Steel 3403 (0.024% Ti) produced a ¼ sample depth region of uniform ultrafine ferrite grains (FIG. 13A) and a centre region consisting of angular and some acicular ferrite grains, dispersed carbides and discrete islands of martensite (FIG. 13B). A similar steel with 0.20% Mo addition (3404) resulted in a similar structure, although the surface layers consisted of even finer ferrite grains (<1–2 μm) (FIG. 14A) and the ferrite in the centre of the samples was finer and more acicular (FIG. 14B). Once again there were small packets of martensite present.

Figure 15A:
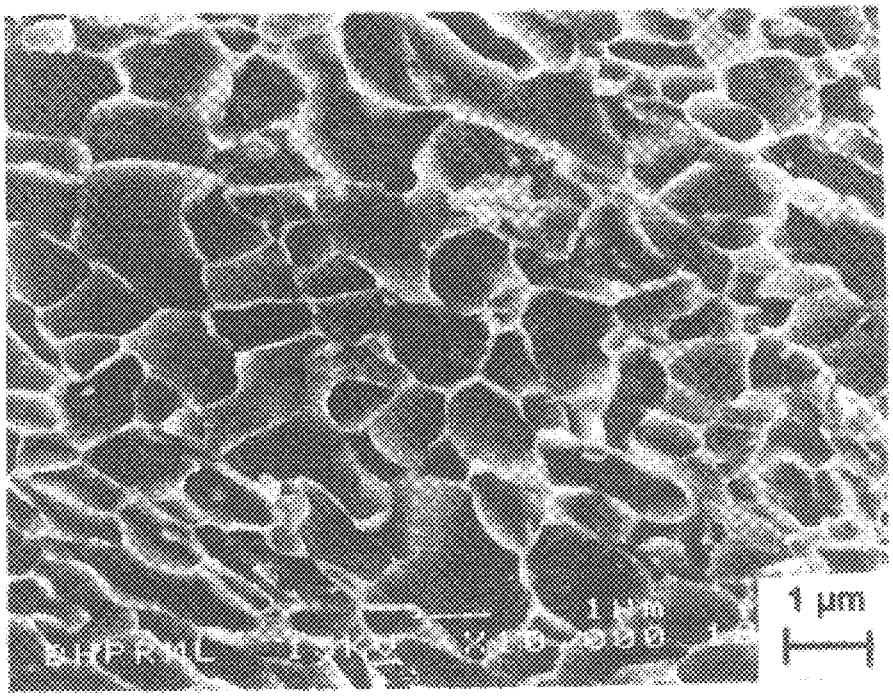
FIG. 15A is a scanning electron micrograph showing ultrafine ferrite in surface regions of high Ti steel (3394)
Figure 15B:
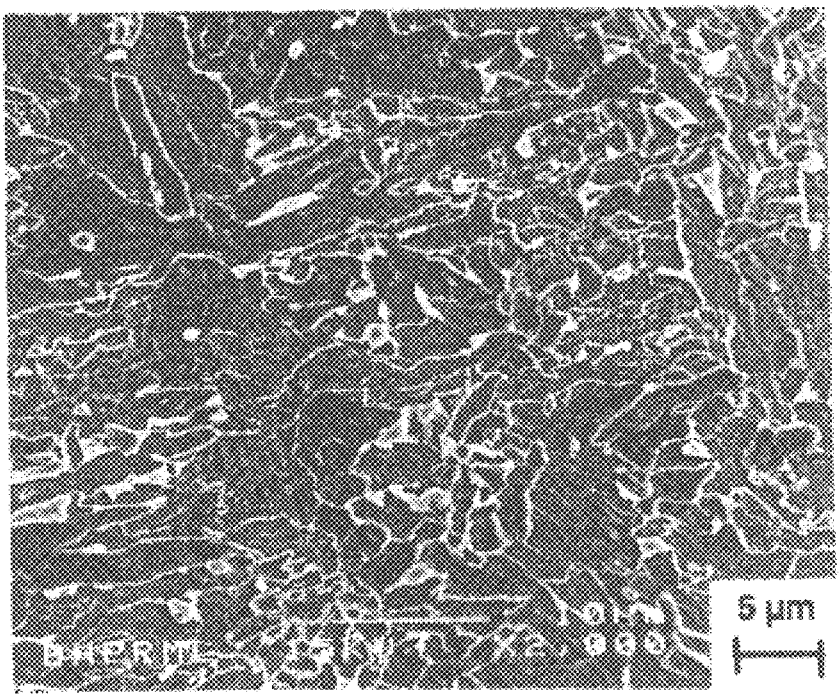
FIG. 15B is a scanning electron micrograph showing acicular ferrite and martensite islands in centre regions of high Ti steel (3394)

Higher additions of Ti, such as in welding rod steel (3393 and 3394) resulted in ultrafine ferrite surface layers (FIG. 15A) and extremely fine acicular ferrite structures in the cental regions (FIG. 15B). The ultrafine ferrite could not be resolved using optical microscopy, however, electron microscopy revealed sub-micron grains. Once again, isolated islands of martensite were scattered throughout the acicular ferrite.

Nb Additions

Two conventional steel grades containing both Nb and Ti, XF400 and XF500, were processed and produced similar surface microstructures consisting of ferrite grains down to about 1 μm in size, but slightly different centre structures. The central regions of the XF400 sample consisted of angular and blocky ferrite grains, which were inconsistent both in terms of size and shape, ranging from about 5 to 15 μm. The XF500 sample, however, produced a finer, slightly more uniform acicular ferrite microstructure.

Sample 3370 containing 0.037% Nb was used to investigate the effect of increased feed thickness, lubrication and coiling after rolling. The standard sample with initial thickness of 2 mm (3370-1) consisted of the usual ultrafine ferrite to ¼ sample depth, together with a mixture of angular and acicular ferrite in the centre. When the feed thickness was increased to 4 mm (sample 3370-2), the grain size in the surface regions was not quite as fine (up to about 4 μm), and the depth of penetration was not as great, probably only reaching about ⅕ sample depth. The temperature drop in the roll gap was just over 50° C. Lubrication was employed for sample 3370-3 and the temperature drop increased to more than 140° C., most likely due to the heat conducting effect of the lubrication. The grain size in the surface regions was similar, but less uniform and the depth of this region had decreased even further. The microstructure of the central regions remained essentially similar. Sample 3370-4 (2 mm input thickness) was coiled at 600° C. after rolling at 750° C., which was a lower delivery temperature than for the first three samples. The depth of the ultrafine surface regions approached ⅓ of the sample thickness, probably the greatest penetration of all the samples. The grain size in that region was less than 1 μm. The central regions remained relatively unchanged and so coiling did not appear to significantly alter the overall microstructure.

Other Additions

Samples 3607 and 3608 both contained Mo and Ti, with 3608 containing 0.002% B. The addition of B did not appear to change the microstructure significantly, with both samples consisting of the standard depth of ultrafine grains and angular ferrite grains in the centre. Sample 3608-1 had a region right at the surface which was not ultrafine, although this may have been the result of decarburisation. Steel 3607 was also coiled at 600° C. after rolling (3607-2), however the entry roll temperature was 50° C. lower than for 3607-1, making a comparison of the two difficult. Nevertheless, there was little microstructural change after coiling.

Steel 3399 contained 0.48% Cr, and produced a region of 1–2 μm ferrite grains near the surface, and acicular ferrite with a considerable volume fraction of martensite islands in the centre of the strip.

MEDIUM CARBON STEELS

Figure 16A:
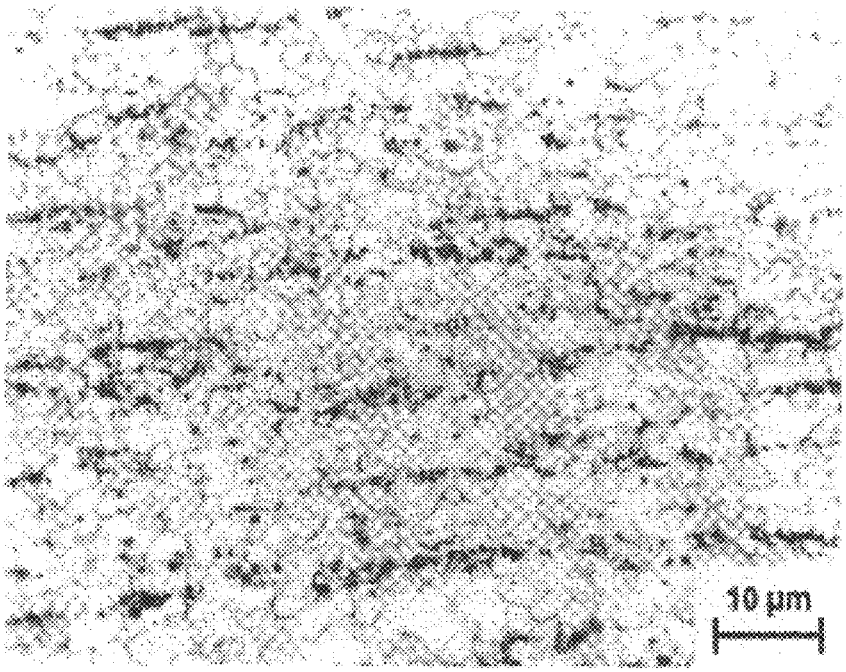
FIG. 16A is an optical micrograph showing ultrafine ferrite and carbide segregation in surface regions of 0.21 C-0.99 Mn steel (3374)
Figure 16B:
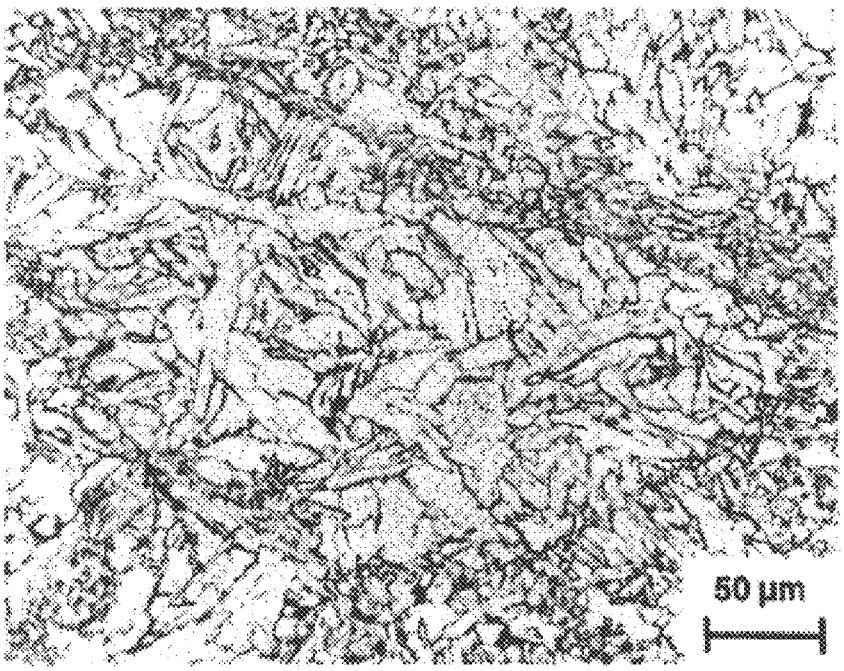
FIG. 16B is an optical micrograph showing necklacing and acicular ferrite in centre regions of 0.21 C-0.99 Mn steel (3374)
Figure 17A:
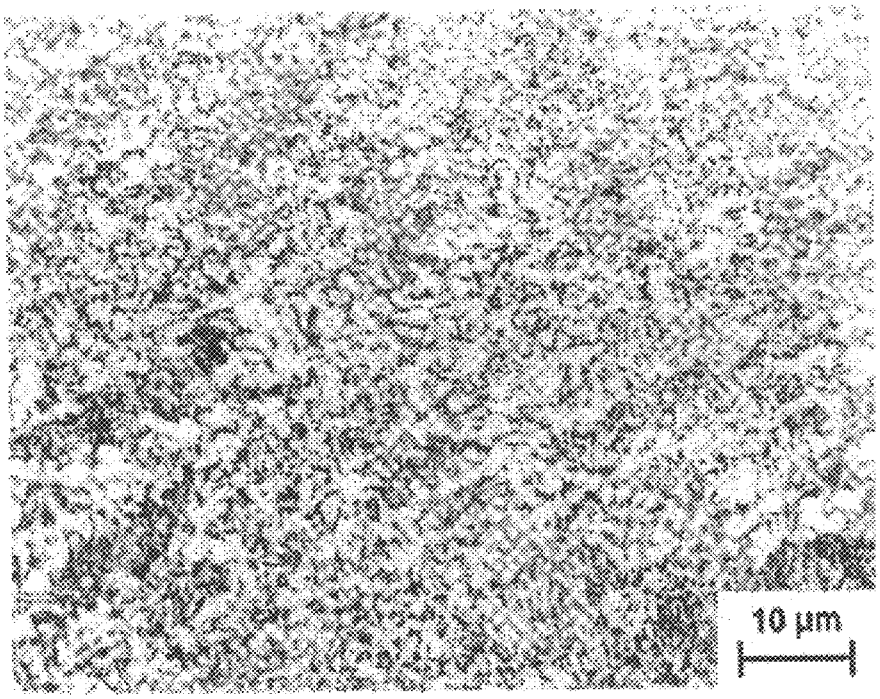
FIG. 17A is an optical micrograph showing ultrafine ferrite and carbides in surface regions of 1040 steel.
Figure 17B:
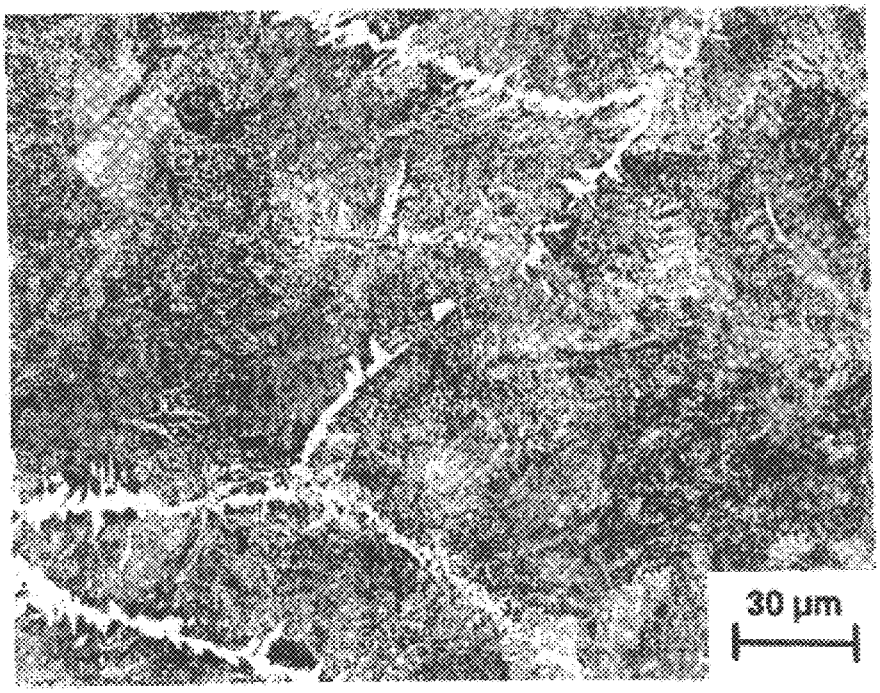
FIG. 17B is an optical micrograph showing pearlite and proeutectoid ferrite in centre regions of 1040 steel.
Figure 17C:
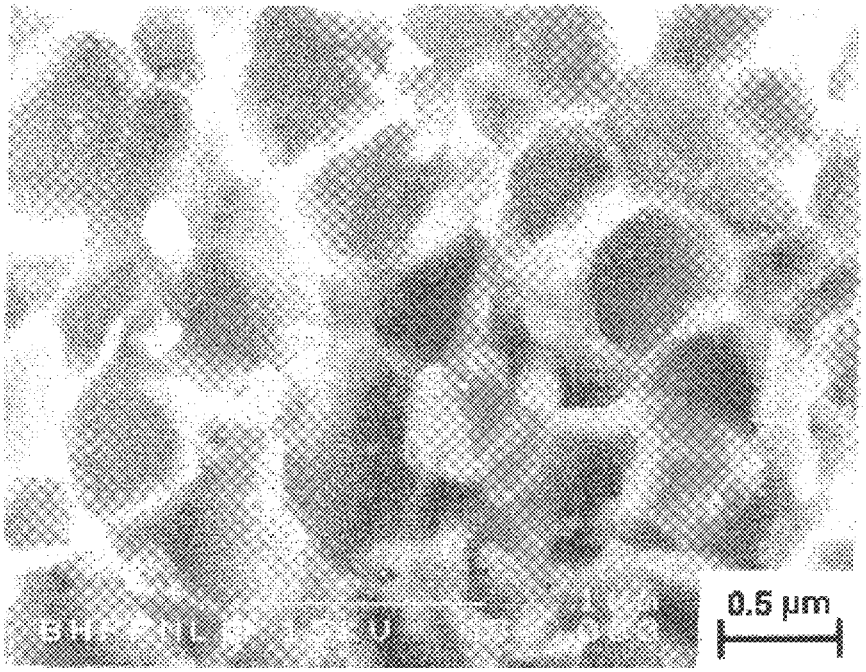
FIG. 17C is a scanning electron micrograph showing carbide distribution in surface regions of 1040 steel after air cooling.
Figure 17D:
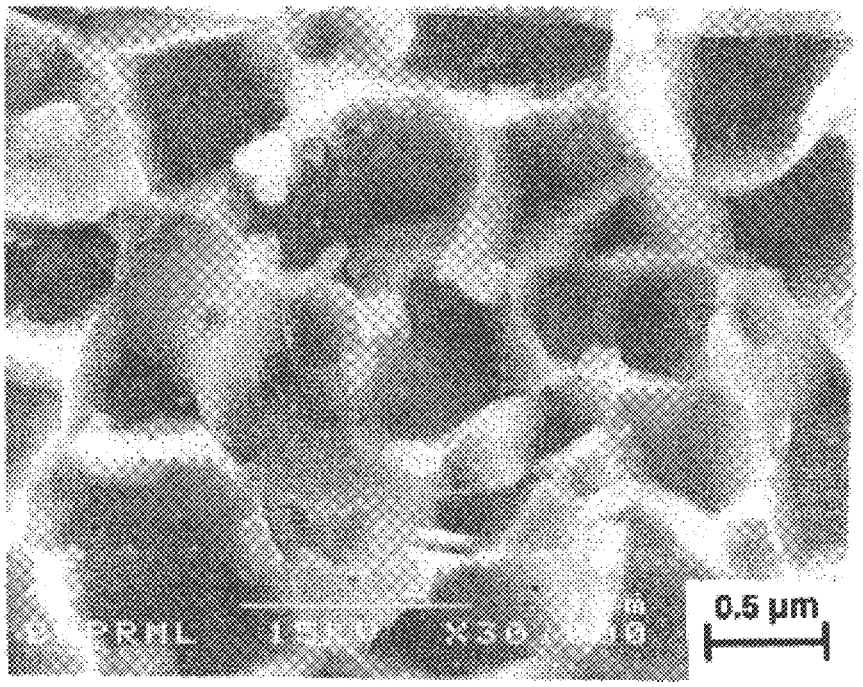
FIG. 17D is a scanning electron micrograph showing carbide distribution in surface regions of 1040 steel after coiling at 600° C.

These grades contained about 0.2 to 0.4% C and in some cases Ti, V and B. The plain carbon sample 3374, contained 0.21% C and consisted of a surface region of equiaxed ferrite grains of size 1–3 μm with fine carbides segregated into rows (FIG. 16A). Acicular ferrite was present in the centre and there was some necklacing of fine ferrite grains around prior austenite grains boundaries (FIG. 16B). The second plain carbon steel (1040) was processed under three conditions; namely rolling at 750 and 700° C. followed by air cooling, and rolling at 750° C. with coiling at 600° C. All samples had the characteristic ultrafine microstructure to a depth of ⅓ sample thickness. In this region, there was very fine ferrite and a high volume fraction of carbides distributed throughout (FIG. 17A). Proeutectoid ferrite formed in the centre of the strips, outlining the prior austenite grain boundaries, however the majority of this region was pearlitic (FIG. 17B). In this case, coiling did not appear to significantly alter the carbide distribution (FIGS. 17C and D).

Figure 18A:
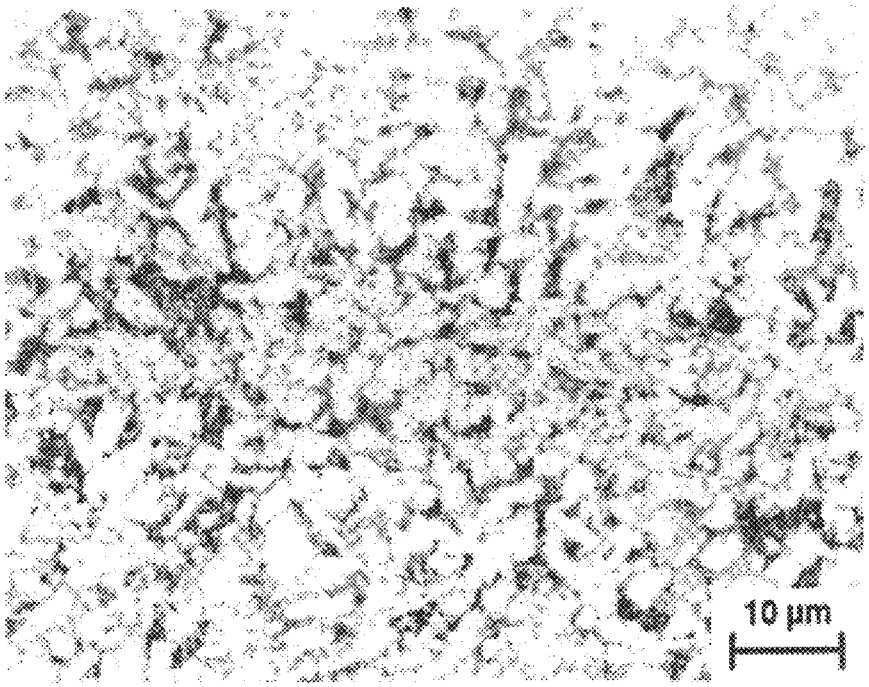
FIG. 18A is an optical micrograph showing carbide distribution in surface regions of 0.27 C-0.12 V steel (3524) after air cooling.
Figure 18B:
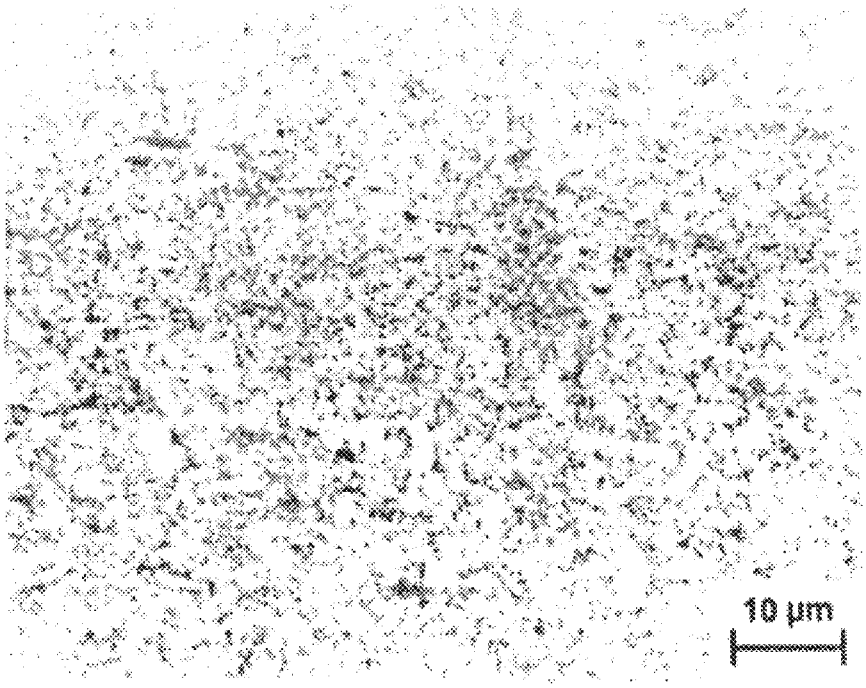
FIG. 18B is an optical micrograph showing carbide distribution in surface regions of 0.27 C-0.12 V steel (3524) after coiling at 600° C.

Samples 3521 (Ti addition) and 3524 (Ti and V additions) were both processed under the same conditions as the 1040 grade. Both compositions had similar microstructures for almost all conditions. These consisted of ultrafine ferrite grains and carbides in the surface regions, although the carbides appear as finer, more discrete particles for the two samples coiled at 600° C. (compare FIGS. 18A and B). The ultrafine grains were also slightly finer in the samples rolled at lower temperatures (3521-3 and 3524-3). The center regions consisted of acicular ferrite grains distributed throughout a pearlitic matrix. These acicular structures were generally finer in the sample containing V and were particularly refined in sample 3524-3.

Figure 19A:
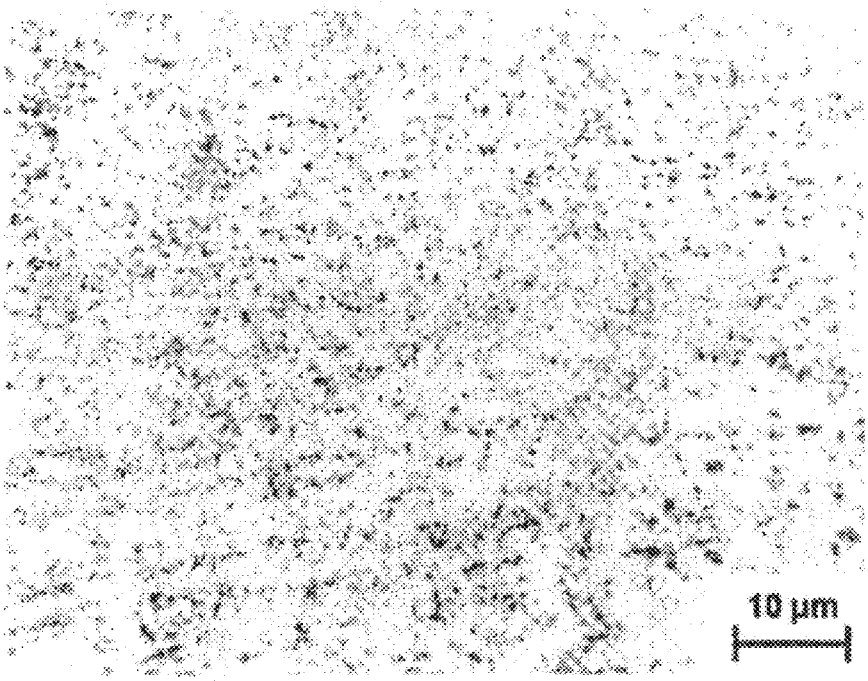
FIG. 19A is an optical micrograph showing ultrafine ferrite in surface regions of Ti-B medium C steel (3605) after 1250° C. reheat.
Figure 19B:
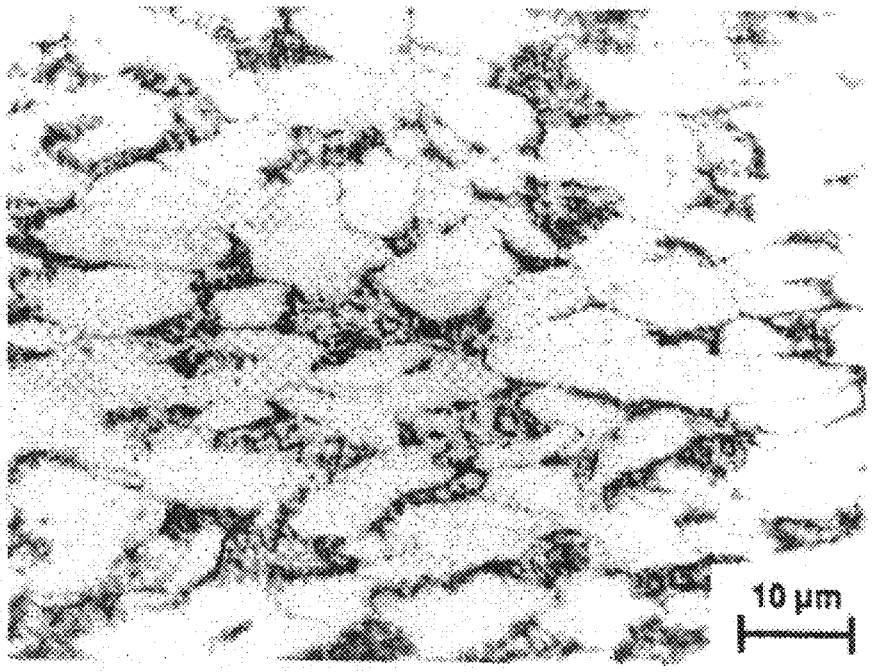
FIG. 19B is an optical micrograph showing coarse, worked ferrite in surface regions of Ti-B medium C steel (3605) after 950° C. reheat.

The final medium carbon steel (3605) contained Ti and B. Its microstructure was similar to the lower carbon samples, 3607 and 3608 (alloyed with Ti, Mo and B), although there were more carbides present, particularly in the ultrafine surface regions (FIG. 19A), as would be expected. A second sample (3605-2) was reheated to only 950° C. before rolling and similar to sample 3398-2, consisted of relatively coarse worked ferrite grains in the surface regions, together with distinct small regions of carbides and ultrafine grains or sub-grains (FIG. 19B). Ferrite grains in the centre regions were reasonably equiaxed. This same material was also reheated to both 950 and 1250° C., quenched and etched for austenite grain boundaries. The lower reheat produced 10–20 $\mu$m grains, while the higher reheat resulted in grains from 100 to 400 $\mu$m in size.

HIGH CARBON STEELS

Figure 20A:
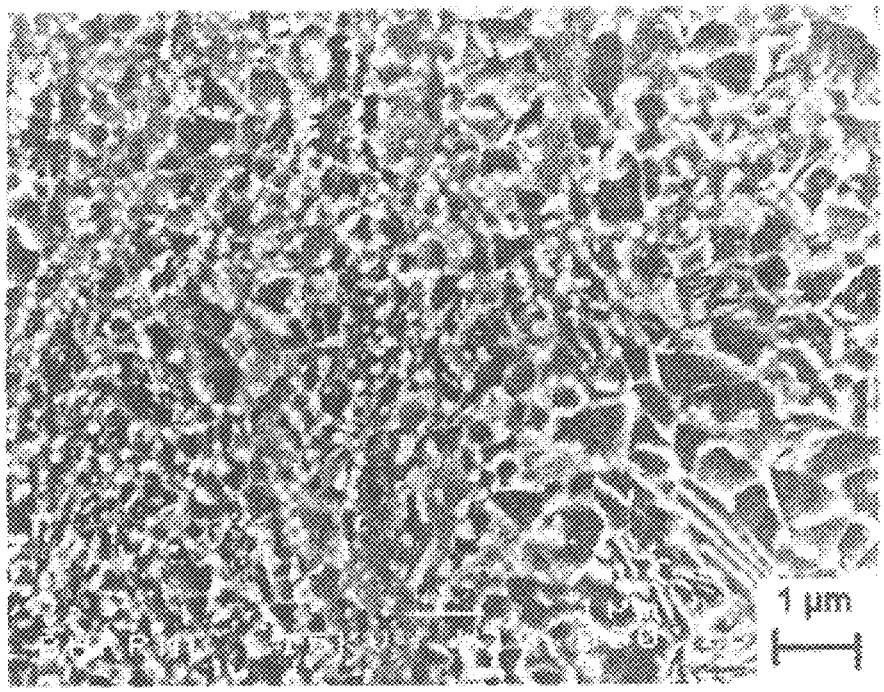
FIG. 20A is a scanning electron micrograph showing ultrafine ferrite in surface regions of 1077 eutectoid steel.
Figure 20B:
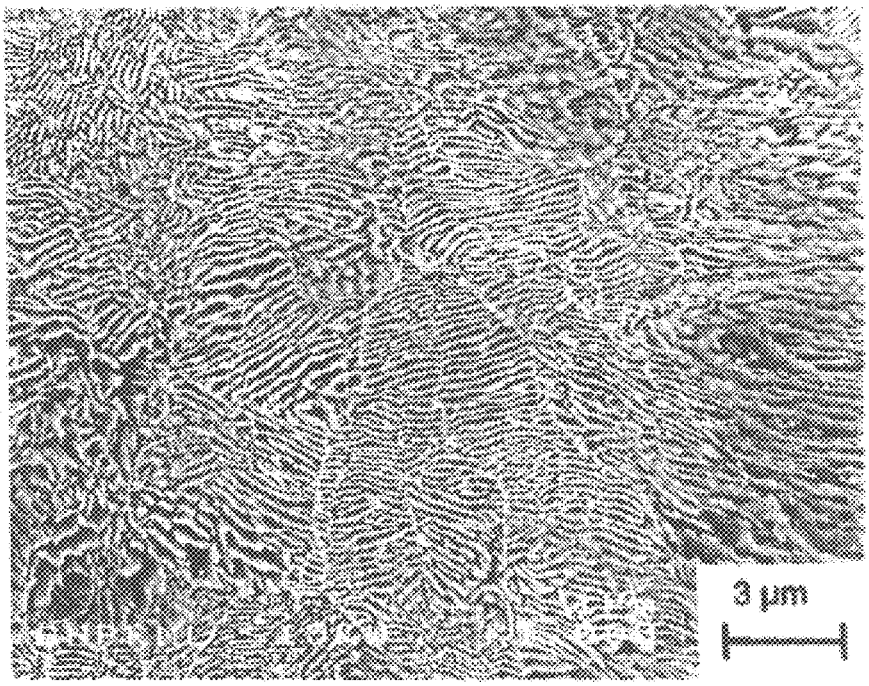
FIG. 20B is a scanning electron micrograph showing pearlite in centre regions of 1077 eutectoid steel.

The two pearlitic steels, 1062 and 1077, were both rolled under the same three conditions used to process samples 3521, 3524 and 1040. There appeared to be little difference between the microstructures produced under the various conditions. There was again evidence of shearing in the surface regions of both steels, with ultrafine ferrite grains (less than 1 $\mu$m in size) and discrete carbides present in these regions (FIG. 20). The depth of ultrafine ferrite was, however, less than that observed in the low carbon samples, although this may have been due to the lower reductions achieved (generally 20 to 25%). The centre regions consisted of colonies of pearlite, with microstructures similar to those expected in conventionally processed high carbon grades (FIG. 20).

MECHANICAL PROPERTIES

Figure 21:
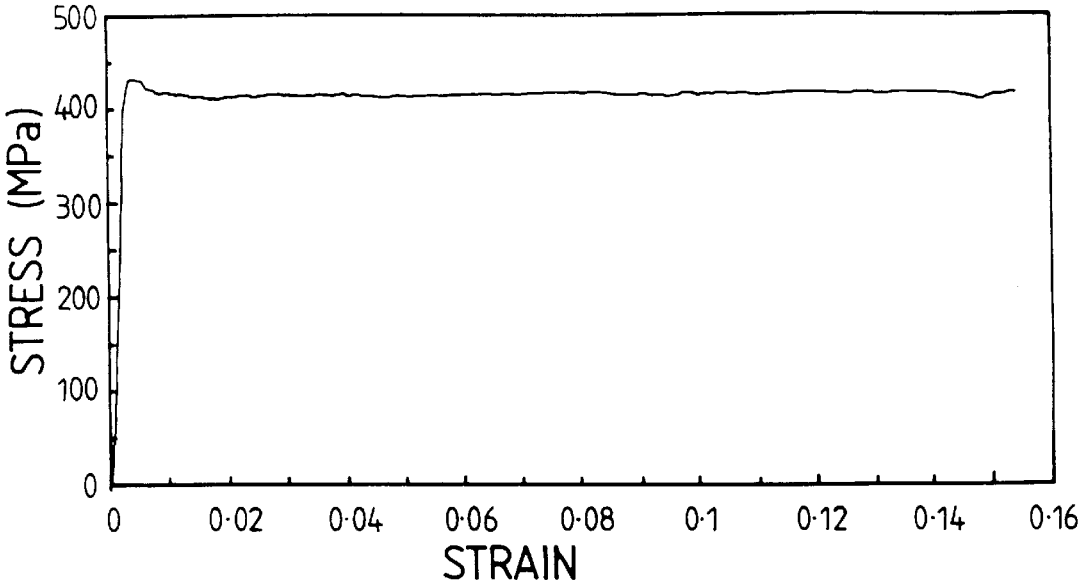
FIG. 21 is a stress-strain curve of low C steel (A06) displaying no work hardening.
Figure 22:
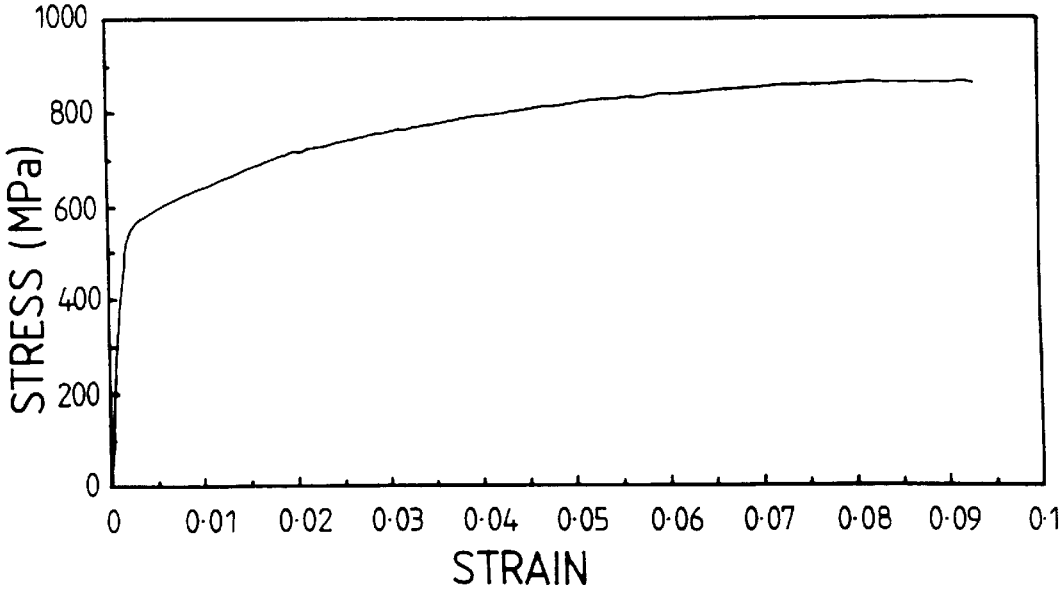
FIG. 22 is a stress-strain curve of high C steel (1062) displaying a relatively high level of work hardening.

Mechanical properties of all steels are shown in Table 3. The 0.2% proof stress was determined for the higher C steels since there was no definite upper or lower yield point. One of the most unusual aspects of these results was the flatness of many of the stress-strain curves, especially for the lower C grades. This is reflected in the ratio YS/UTS, which in many cases was close to 1.00. An example of this absence of work hardening is shown in the stress-strain curve of sample A06-8 (FIG. 21), where the maximum stress occurred at the upper yield point. After this, the stress dropped and remained below the initial level. The higher C steels did work harden to a much greater extent, in particular the 1040, 1062 and 1077 commercial grades. A typical curve is shown in FIG. 22 (sample 1062-1).

The results show that very high strengths are achievable with this type of processing. A plain low carbon steel (M06-9) has obtained a yield strength of 590 MPa together with 16% total elongation and A06-8 produced twice that elongation with a yield strength of 430 MPa The third plain C steel (3373) containing 0.065% C also had excellent properties: LYS and UTS of 520 and 580 MPa respectively, and total elongation of 23%. Of the lower C steels, the greatest strength properties were obtained in the two welding rods steels (3393 and 3394) with LYS of 745 and 830 MPa. Lowering the reheat temperature in samples 3398 and 3605 produced significant strength increments, although ductility was adversely affected. This is an interesting result given the transition from an ultrafine ferrite microstructure after high reheat, to a coarser, worked ferrite structure after low reheat.

The results for M06 rolled under various conditions indicate that several processing factors can influence the final properties. Roll entry temperature (M06- 1,2 and 4) did not significantly change the strength of the material, although a high rolling temperature produced the most ductile strip. Coiling after rolling softened the material and increased elongation, as did rolling at higher speeds (M06-16). The low reheat (M06-13) produced properties only slightly inferior to the normal high reheat strip (M06-14) despite the formation of a completely different microstructure. As expected from the microstructures, samples processed with lubricated rolls produced much higher strengths than the scaled samples. Not surprisingly, the relatively coarse microstructure of scaled sample M06-21 resulted in by far the softest strip of all materials tested.

The higher C grades displayed continuous yielding and so a proof stress was measured instead of LYS. These steels displayed greater work hardening than the lower C samples and produced some very high strength values. Due to its Ti and V additions, sample 3524 obtained proof and tensile strengths higher than 1040 grade despite the lower C content, along with equivalent ductility. The pearlitic steels 1062 and 1077 had strengths greater than those usually obtained under industrial conditions (in bar form), although total elongations were lower. In all medium and high C grade steels, coiling at 600° C. decreased both PS and UTS (by over 100 MPa in the case of 1077) but had little effect on ductility. With the exception of heat 3524, a decrease in roll entry temperature by 50° C. produced a strength increment of at least 30 MPa.

At the present time the exact mechanism by which the transformation of the austenite phase steel to an ultrafine microstructure occurs is not fully understood. It is theorised that by reducing the grain boundary area in the austenite phase and then by applying a pre-cooling, the driving force to cause the transformation to a ferrite phase becomes very high. However, there is insufficient grain boundary area to achieve nucleation. Therefore by treating the steel (ie deforming the steel) while in the austenite phase and before any substantial transformation has commenced a strain induced homogenous transformation to the ferrite phase occurs. This homogenous transformation occurs rapidly and the ferrite grain size is extremely small.

The transformation to fine ferrite grains is ascribed to a homogenous transformation rather than to a dynamic recrystallisation of the transformed ferrite as taught by U.S. Pat. No. 4,466,842.

TABLE 1

COMPOSITION OF ALL STEELS INVESTIGATED (IN WT %)

| Steel ID | C | P | Mn | Si | S | Cr | Mo | AI | Nb | Ti | V | B | N |
|---|---|---|---|---|---|---|---|---|---|---|---|---|---|
| 3394 | 0.036 | 0.017 | 1.39 | 0.62 | 0.012 | 0.019 | 0.006 | 0.013 | <0.005 | 0.12 | 0.005 | <0.0003 | 0.0056 |
| 3607 | 0.043 | 0.018 | 1.67 | 0.21 | 0.011 | 0.008 | 0.26 | 0.034 | 0.022 | 0.016 | <0.003 | <0.0003 | 0.0035 |
| 3608 | 0.044 | 0.019 | 1.73 | 0.22 | 0.01 | 0.009 | 0.26 | 0.03 | 0.022 | 0.017 | <0.003 | 0.0019 | 0.0035 |
| A06 | 0.06 | 0.013 | 0.21 | 0.005 | 0.011 | 0.017 | 0.002 | 0.04 | | | | | 0.0036 |
| 3373 | 0.065 | 0.018 | 0.99 | 0.27 | 0.006 | 0.004 | 0.002 | 0.03 | <0.005 | <0.003 | <0.003 | <0.0003 | 0.0018 |
| M06 | 0.075 | 0.015 | 0.51 | 0.26 | 0.008 | 0.018 | 0.002 | 0.005 | | | 0.003 | | |
| 3393 | 0.08 | 0.018 | 1.34 | 0.63 | 0.013 | 0.019 | 0.007 | 0.017 | <0.005 | 0.16 | 0.006 | 0.0003 | 0.0077 |
| XF400 | 0.09 | 0.015 | 0.71 | 0.015 | 0.005 | 0.02 | 0.002 | 0.03 | 0.027 | 0.025 | | | 0.0034 |
| 3403 | 0.10 | 0.017 | 1.50 | 0.76 | 0.011 | 0.017 | 0.005 | 0.026 | <0.005 | 0.024 | <0.003 | 0.0004 | 0.0047 |
| XF500 | 0.10 | 0.018 | 1.47 | 0.08 | 0.005 | 0.037 | 0.004 | .0.03 | 0.045 | 0.031 | 0.004 | 0.0005 | 0.0063 |
| 3370 | 0.105 | 0.005 | 0.86 | 0.29 | 0.005 | 0.004 | 0.002 | 0.019 | 0.037 | 0.006 | <0.003 | <0.0003 | 0.0041 |
| 3398 | 0.105 | 0.018 | 1.38 | 1.40 | 0.011 | 0.017 | 0.004 | 0.026 | <0.005 | 0.004 | <0.003 | <0.0003 | 0.0038 |
| 3399 | 0.105 | 0.018 | 1.38 | 0.16 | 0.011 | 0.48 | 0.004 | 0.024 | <0.005 | <0.003 | <0.003 | <0.0003 | 0.0041 |
| 3404 | 0.105 | 0.017 | 1.50 | 0.31 | 0.012 | 0.017 | 0.20 | 0.022 | <0.005 | 0.022 | <0.003 | <0.0003 | 0.0051 |
| 3605 | 0.175 | 0.019 | 1.68 | 0.20 | 0.013 | 0.008 | 0.003 | 0.038 | <0.005 | 0.017 | <0.003 | 0.0016 | 0.0043 |
| 3374 | 0.21 | 0.02 | 0.99 | 0.29 | 0.006 | 0.003 | 0.002 | 0.033 | <0.005 | <0.003 | <0.003 | <0.0003 | 0.0025 |
| 3524 | 0.27 | 0.005 | 1.67 | 0.36 | 0.034 | 0.008 | 0.003 | 0.036 | <0.005 | 0.014 | 0.12 | <0.0003 | 0.014 |
| 3521 | 0.29 | 0.018 | 0.85 | 0.21 | 0.008 | 0.014 | 0.009 | 0.037 | <0.005 | 0.02 | 0.003 | 0.0006 | 0.0023 |
| 1040 | 0.38 | 0.019 | 0.76 | 0.20 | 0.008 | 0.022 | 0.003 | 0.04 | <0.005 | <0.002 | <0.002 | <0.0003 | 0.004 |
| 1062 | 0.63 | 0.023 | 0.75 | 0.22 | 0.019 | 0.04 | 0.01 | 0.03 | | | | | 0.003 |
| 1077 | 0.77 | 0.018 | 0.71 | 0.184 | 0.007 | 0.01 | 0.04 | 0.01 | | | | | 0.004 |

TABLE 2

PROCESSING CONDITIONS FOR ALL STRIPS

| Sample Name | Reheat Temp (° C.) | Roll Speed (m/sec) | Roll/ Sample Condition | Entry Temp (° C.) | Exit Temp (° C.) | Post Roll Cooling | Total Reduction (%) |
|---|---|---|---|---|---|---|---|
| M06-1 | 1250 | 0.37 | | 835 | 710 | Air | 41 |
| M06-2 | 1250 | 0.37 | | 795 | 685 | Air | 35 |
| M06-3 | 1250 | 0.37 | | 740 | 675 | Air | 35 |
| M06-4 | 1250 | 0.37 | | 775 | 685 | Air | 35 |
| M06-5 | 1250 | 0.18 | | 775 | 605 | Air | 30 |
| M06-6 | 1250 | 0.27 | | 785 | 660 | Air | 35 |
| M06-8 | 1250 | 0.37 | Lubricated | 790 | 630 | Air | 57 |
| M06-9 | 1250 | 0.27 | | 800 | 670 | Air | 35 |
| M06-10 | 1250 | 0.37 | Lubricated | 800 | 690 | Air | 41 |
| M06-13 | 950 | 0.30 | | 775 | | Air | 29 |
| M06-15 | 1250 | 0.30 | | 790 | 720 | Coil 650° C. | 29 |
| M06-16 | 1250 | 1.0 | | 800 | 715 | Air | 29 |
| M06-17 | 1250 | 0.30 | Lub 1 Roll | 800 | | Air | 31 |
| M06-18 | 1250 | 0.30 | Lubricated | 800 | | Air | 37 |
| M06-19 | 1250 | 0.30 | Lubricated | 775 | <670 | Air | 40 |
| M06-21 | 1250 | 0.30 | Scaled | 810 | 770 | Air | 31 |
| M06-22 | 1250 | 0.30 | Scaled | 780 | 745 | Air | 31 |
| A06-1 | 1250 | 0.37 | | 800 | 720 | Air | 40 |
| A06-2 | 1250 | 0.37 | | 855 | 745 | Air | 45 |
| A06-3 | 1250 | 0.37 | | 755 | 685 | Air | 35 |
| A06-4 | 1250 | 0.18 | | 810 | 625 | Air | 33 |
| A06-5 | 1050 | 0.37 | | 805 | 700 | Air | 35 |
| A06-6 | 1050 | 0.37 | | 750 | 650 | Air | 33 |
| A06-7 | 1250 | 0.27 | | 900 | 705 | Air | 43 |
| A06-8 | 1250 | 0.37 | | 905 | 760 | Air | 45 |
| 3370-1 | 1250 | 0.37 | | 800 | 695 | Air | 40 |
| 3370-2 | 1250 | 0.37 | | 800 | 745 | Air | 49 |
| 3370-3 | 1250 | 0.37 | Lubricated | 805 | 660 | Air | 54 |
| 3370-4 | 1250 | 0.30 | | 750 | 670 | Coil 600° C. | 44 |
| 3373-1 | 1250 | 0.37 | | 800 | 675 | Air | 35 |
| 3374-1 | 1250 | 0.37 | | 755 | 690 | Air | 40 |
| 3393-1 | 1250 | 0.37 | | 770 | 680 | Air | 40 |
| 3394-1 | 1250 | 0.37 | | 800 | 680 | Air | 41 |
| 3398-1 | 1250 | 0.37 | | 775 | 690 | Air | 40 |
| 3398-2 | 950 | 0.30 | | 775 | 635 | Air | 30 |
| 3399-1 | 1250 | 0.37 | | 800 | 675 | Air | 37 |
| 3403-1 | 1250 | 0.37 | | 810 | 700 | Air | 38 |
| 3404-1 | 1250 | 0.37 | | 765 | 650 | Air | 37 |
| 3605-1 | 1250 | 0.37 | | 765 | 695 | Air | 41 |

TABLE 2-continued

PROCESSING CONDITIONS FOR ALL STRIPS

| Sample Name | Reheat Temp (° C.) | Roll Speed (m/sec) | Roll/ Sample Condition | Entry Temp (° C.) | Exit Temp (° C.) | Post Roll Cooling | Total Reduction (%) |
|---|---|---|---|---|---|---|---|
| 3605-2 | 950 | 0.30 | | 775 | 660 | Air | 31 |
| 3607-1 | 1250 | 0.37 | | 795 | 690 | Air | 35 |
| 3607-2 | 1250 | 0.30 | | 750 | 660 | CoiI 600° C. | 33 |
| 3608-1 | 1250 | 0.37 | | 800 | 715 | Air | 41 |
| XF400-1 | 1250 | 0.37 | | 800 | 700 | Air | 38 |
| XF500-1 | 1250 | 0.37 | | 775 | 675 | Air | 41 |
| 3521-1 | 1250 | 0.30 | | 730 | 660 | Coil 600° C. | 30 |
| 3521-2 | 1250 | 0.30 | | 750 | 660 | Air | 34 |
| 3521-3 | 1250 | 0.30 | | 705 | 625 | Air | 30 |
| 3524-1 | 1250 | 0.30 | | 750 | — | Air | 29 |
| 3524-2 | 1250 | 0.30 | | 750 | — | Coil 600° C. | 29 |
| 3524-3 | 1250 | 0.30 | | 700 | — | Air | 29 |
| 1040-1 | 1250 | 0.30 | | 750 | 615 | CoiI 600° C. | 26 |
| 1040-2 | 1250 | 0.30 | | 750 | 615 | Air | 26 |
| 1040-3 | 1250 | 0.30 | | 700 | 600 | Air | 24 |
| 1062-1 | 1250 | 0.30 | | 760 | 655 | Coil 600° C. | 26 |
| 1062-2 | 1250 | 0.30 | | 755 | 640 | Air | 30 |
| 1062-3 | 1250 | 0.30 | | 690 | 600 | Air | 26 |
| 1077-1 | 1250 | 0.30 | | 735 | 610 | Coii 600° C. | 21 |
| 1077-2 | 1250 | 0.30 | | 755 | 620 | Air | 26 |
| 1077-3 | 1250 | 0.30 | | 700 | 580 | Air | 21 |

TABLE 3

MECHANICAL PROPERTIES OF ALL STEELS (SPECIMENS FROM SAMPLE 3608 REACHED STRESSES OF 517 AND 538 $MP_A$ BEFORE FAILING PREMATURELY)

| Sample Name | LYS (MPa) | 0.2% PS (MPa) | UTS (MPa) | LYS/UTS PS/UTS | TE (%) (75 mm) |
|---|---|---|---|---|---|
| 3394-1 | 745 | | 748 | 1.00 | 11 |
| 3607-1 | 495 | | 507 | 0.98 | 17 |
| 3607-2 | 446 | | 494 | 0.90 | 19 |
| A06-8 | 432 | | 432 | 1.00 | 32 |
| 3373-1 | 520 | | 580 | 0.90 | 23 |
| M06-1 | 490 | | 507 | 0.97 | 25 |
| M06-2 | 471 | | 497 | 0.95 | 13 |
| M06-4 | 502 | | 520 | 0.97 | 19 |
| M06-9 | 589 | | 589 | 1.00 | 16 |
| M06-10 | 540 | | 552 | 0.98 | 17 |
| M06-11 | 481 | | 523 | 0.92 | 22 |
| M06-13 | 481 | | 538 | 0.89 | 14 |
| M06-15 | 435 | | 472 | 0.92 | 22 |
| M06-16 | 428 | | 490 | 0.87 | 23 |
| M06-18 | 566 | | 607 | 0.93 | 14 |
| M06-21 | 306 | | 360 | 0.85 | 16 |
| 3393-1 | 830 | | 874 | 0.95 | 16 |
| XF400-1 | 576 | | 576 | 1.00 | 11 |
| 3403-1 | 535 | | 609 | 0.88 | 26 |
| XF500-1 | 670 | | 672 | 1.00 | 11 |
| 3370-1 | 603 | | 617 | 0.98 | 17 |
| 33704 | 633 | | 633 | 1.00 | 8 |
| 3398-1 | 580 | | 634 | 0.91 | 20 |
| 3398-2 | 662 | | 720 | 0.92 | 11 |
| 3399-1 | 520 | | 605 | 0.86 | 22 |
| 3404-1 | 530 | | 695 | 0.76 | 20 |
| 3605-1 | 490 | | 499 | 0.98 | 23 |
| 3605-2 | 521 | | 557 | 0.94 | 13 |
| 3374-1 | 500 | | 505 | 0.99 | 26 |
| 3524-1 | | 742 | 873 | 0.85 | 17 |
| 3524-2 | | 696 | 792 | 0.88 | 14 |
| 3524-3 | | 745 | 840 | 0.89 | 12 |
| 3521-1 | | 545 | 607 | 0.90 | 18 |
| 3521-2 | | 581 | 631 | 0.92 | 18 |
| 3521-3 | | 611 | 664 | 0.92 | 16 |
| 1040-1 | | 517 | 731 | 0.71 | 13 |
| 1040-2 | | 542 | 733 | 0.74 | 14 |
| 1040-3 | | 575 | 768 | 0.75 | 13 |

TABLE 3-continued

MECHANICAL PROPERTIES OF ALL STEELS (SPECIMENS FROM SAMPLE 3608 REACHED STRESSES OF 517 AND 538 $MP_A$ BEFORE FAILING PREMATURELY)

| Sample Name | LYS (MPa) | 0.2% PS (MPa) | UTS (MPa) | LYS/UTS PS/UTS | TE (%) (75 mm) |
|---|---|---|---|---|---|
| 1062-1 | | 573 | 864 | 0.66 | 8 |
| 1062-2 | | 613 | 875 | 0.70 | 8 |
| 1062-3 | | 671 | 945 | 0.71 | 9 |
| 1077-1 | | 627 | 959 | 0.65 | 8 |
| 1077-2 | | 729 | 1067 | 0.68 | 7 |
| 1077-3 | | 777 | 1094 | 0.71 | 6 |

What is claimed is:

1. A method of producing a steel having one or more zones of ultrafine microstructure comprising treating an austenite phase steel having a mean austenite grain size greater than 50 microns before any substantial transformation has commenced so as to induce a rapid substantially complete transformation to an ultrafine microstructure in one or more zones of the microstructure.

2. A method of producing a steel having one or more zones of ultrafine microstructure comprising heating a steel to austenitise the steel, pre-cooling the austenite phase steel to produce an austenite phase steel having a mean austenite grain size greater than 50 microns, and treating this pre-cooled austenite phase steel before any substantial transformation has commenced so as to induce a rapid substantially complete transformation to an ultrafine microstructure in one or more zones of the microstructure.

3. A method of producing a steel having one or more zones of ultrafine microstructure comprising partially pre-cooling freshly cast austenite phase steel to produce an austenite phase steel having a mean austenite phase steel before any substantial transformation has commenced so as to induce a rapid substantially complete transformation to an ultrafine microstructure in one or more zones of the microstructure.

4. A method according to claim 2 wherein said pre-cooling of the austenite phase steel is by natural air, forced air or water cooling at a rate in the range 50 to 2000 K°/min.

5. A method according to claim 1 wherein the treatment applied to the austenite phase steel is a deformation.

6. A method according to claim 5 wherein the deformation is performed at a temperature in the range of 600° C. to 950° C.

7. A method according to claim 5 wherein, for producing a low carbon steel, the deformation is performed at a temperature in the range of 700° to 950° C.

8. A method of producing a steel having one or more zones of ultrafine microstructure comprising deforming an austenite phase steel having a mean austenite grain size greater than 50 microns before any substantial transformation has commenced to develop a strain profile or strain gradient across the structure of the steel so as to induce a rapid substantially complete transformation to an ultrafine microstructure in one or more zones of the microstructure.

9. A method according to claim 8 wherein the zone of the ultrafine microstructure comprises a whole cross-section of the structure.

10. A method according to claim 8 wherein the zones of the ultrafine microstructure comprises a surface layer or layers of the steel.

11. A method according to claim 8 wherein the strain profile comprises a relatively higher strain in a surface layer or layers of the steel and a relatively lower strain in the core.

12. A method according to claim 11 wherein the strain inhomogeneity is enhanced by having friction conditions existing between the surface of the steel being deformed and the means by which the steel is deformed.

13. A method according to claim 5 wherein the deformation comprises passing the steel between a pair of contra-rotating rolls effective to reduce a thickness dimension of the steel by a proportion in the range 20 to 70%.

14. A method according to claim 13 wherein the thickness dimension of the steel is reduced by a proportion of 30 to 60%.

15. A method according to claim 13 where only a single pass of the steel is performed to achieve deformation.

16. A method according to claim 13 wherein the rolling speed is in the range 0.1 to 5.0 m/s.

17. A method according to claim 13 when dependent on claim 8 wherein the ratio of the rolling arc ($L_d$) of the rolls to nip gap or rolling thickness ($H_m$) is greater than 10.

18. A method according to claim 2 wherein the steel is heated to a temperature between 1000° C. to 1400° C.

19. A method according to claim 2 wherein the steel is heated to a temperature in the range 1100° C. to 1300° C.

20. A method according to claim 1 wherein the steel is cooled after the transformation.

21. A method according to claim 1 wherein the steel is pretreated in a manner effective to reduce or substantially eliminate grain boundary nucleation of grains, whereby to facilitate said rapid substantially complete transformation.

22. A method according to claim 21 wherein the pretreatment comprises a pretreatment to enlarge the mean austenite grain size of a selected steel or may alternatively or additionally comprise a chemical treatment selected to reduce grain boundary reactivity.

23. A method according to claim 21 wherein the pretreatment entails a pre-cooling of the steel from a higher temperature.

24. A method according to claim 5 wherein said pre-cooling of the austenite phase steel is by natural air, forced air or water cooling at a rate in the range of 50 to 2000 K°/min.

25. A method according to claim 8 wherein the deformation comprises passing the steel between a pair of contra-rotating rolls effective to reduce a thickness dimension of the steel by a proportion in the range 20 to 70%.

26. A method according to claim 25 wherein the thickness dimension of the steel is reduced by a proportion of 30 to 60%.

27. A method according to claim 25 where only a single pass of the steel is performed to achieve deformation.

28. A method according to claim 25 wherein the rolling speed is in the range 0.1 to 5.0 m/s.

29. A method according to claim 25 wherein the ratio of the rolling arc ($L_d$) of the rolls to nip gap or rolling thickness ($H_m$) is greater than 10.

30. A method according to claim 2 wherein the steel is cooled after the transformation.

31. A method according to claim 3 wherein the steel is cooled after the transformation.

32. A method according to claim 5 wherein the steel is cooled after the transformation.

33. A method according to claim 8 wherein the steel is cooled after the transformation.

34. A method according to claim 10 wherein the steel is cooled after the transformation.

35. A method according to claim 2 wherein the steel is pretreated in a manner effective to reduce or substantially eliminate grain boundary nucleation of grains, thereby facilitating said rapid substantially complete transformation.

36. A method according to claim 3 wherein the steel is pretreated in a manner effective to reduce or substantially eliminate grain boundary nucleation of grains, thereby facilitating said rapid substantially complete transformation.

37. A method according to claim 5 wherein the steel is pretreated in a manner effective to reduce or substantially eliminate grain boundary nucleation of grains, thereby facilitating said rapid substantially complete transformation.

38. A method according to claim 8 wherein the steel is pretreated in a manner effective to reduce or substantially eliminate grain boundary nucleation of grains, thereby facilitating said rapid substantially complete transformation.

39. A method according to claim 10 wherein the steel is pretreated in a manner effective to reduce or substantially eliminate grain boundary nucleation of grains, thereby facilitating said rapid substantially complete transformation.

* * * * *